US010364658B2

(12) United States Patent
Michel

(10) Patent No.: US 10,364,658 B2
(45) Date of Patent: Jul. 30, 2019

(54) DOWNHOLE PUMP WITH CONTROLLED TRAVELING VALVE

(71) Applicant: William Michel, Clairfontaine (FR)

(72) Inventor: William Michel, Clairfontaine (FR)

(73) Assignee: VLP LIFT SYSTEMS, LLC, Richmond, TX (US)

( * ) Notice: Subject to any disclaimer, the term of this patent is extended or adjusted under 35 U.S.C. 154(b) by 317 days.

(21) Appl. No.: 15/262,313

(22) Filed: Sep. 12, 2016

(65) Prior Publication Data

US 2017/0096884 A1 Apr. 6, 2017

Related U.S. Application Data

(60) Provisional application No. 62/218,087, filed on Sep. 14, 2015.

(51) Int. Cl.

| | |
|---|---|
| ***F04B 47/02*** | (2006.01) |
| ***F04B 53/12*** | (2006.01) |
| ***F04B 39/10*** | (2006.01) |
| ***E21B 43/12*** | (2006.01) |
| ***F04B 53/14*** | (2006.01) |
| *F04B 39/00* | (2006.01) |

(52) U.S. Cl.

CPC ..... *E21B 43/127* (2013.01); *F04B 39/1013* (2013.01); *F04B 47/02* (2013.01); *F04B 53/125* (2013.01); *F04B 53/14* (2013.01); *F04B 39/0016* (2013.01)

(58) Field of Classification Search

CPC ..... F04B 47/02; F04B 53/12; F04B 53/125; F04B 53/129; F04B 39/0016; F04B 39/1013; F16K 15/026; F16K 15/021; F16K 15/063

See application file for complete search history.

(56) References Cited

U.S. PATENT DOCUMENTS

| | | | | |
|---|---|---|---|---|
| 2,344,786 A | | 3/1944 | Patterson et al. | |
| 3,479,958 A | * | 11/1969 | Anderson | F04B 47/00 417/437 |
| 3,692,438 A | * | 9/1972 | Schapel | F04B 9/125 417/547 |
| 4,599,051 A | | 7/1986 | Spears | |
| 4,691,735 A | | 9/1987 | Horton | |
| 4,708,597 A | | 11/1987 | Fekete | |

(Continued)

*Primary Examiner* — Bryan M Lettman

(74) *Attorney, Agent, or Firm* — Egbert, McDaniel & Swartz, PLLC

(57) ABSTRACT

A fluid pump apparatus for an artificial lift system has a barrel, a standing valve positioned at a lower end of the barrel, a plunger reciprocatingly mounted within the barrel, and a traveling valve positioned in an interior of the plunger so as to control fluid flow through the plunger. The barrel has an opening at a top thereof and an opening at a lower end thereof. The standing valve is movable between an open position and a closed position. The plunger has a first aperture at an upper portion of the plunger and a second aperture extending through a wall of the plunger so as to open to a channel extending longitudinally through the plunger. The traveling valve has a head portion of the body extending downwardly from the head portion. The body is slidably movable within an interior of the plunger. The body has a fluid-passing channel therein that opens to an exterior of the body.

13 Claims, 19 Drawing Sheets

(56) References Cited

U.S. PATENT DOCUMENTS

| | | | | |
|---|---|---|---|---|
| 4,741,679 | A | | 5/1988 | Blassingame |
| 4,781,543 | A | | 11/1988 | Sommer |
| 4,781,547 | A | | 11/1988 | Madden |
| 4,867,242 | A | | 9/1989 | Hart |
| RE33,136 | E | | 12/1989 | Courrege |
| 4,907,953 | A | | 3/1990 | Hebert et al. |
| 5,040,608 | A | * | 8/1991 | Doan ..... E21B 23/01 166/106 |
| 5,139,398 | A | * | 8/1992 | Downing ..... F04B 53/1037 417/511 |
| 5,141,411 | A | | 8/1992 | Klaeger |
| 5,407,333 | A | | 4/1995 | Lambright |
| 5,628,624 | A | | 5/1997 | Nelson |
| 5,829,952 | A | | 11/1998 | Shadden |
| 6,481,987 | B2 | | 11/2002 | Ford |
| 7,051,813 | B2 | | 5/2006 | Hayes et al. |
| 7,878,767 | B2 | | 2/2011 | Ford |
| 2005/0053503 | A1 | | 3/2005 | Gallant |
| 2013/0025846 | A1 | | 1/2013 | Scott |

* cited by examiner

DOWNHOLE PUMP WITH CONTROLLED TRAVELING VALVE

CROSS-REFERENCE TO RELATED APPLICATIONS

The present application claims priority from U.S. Provisional Patent Application Ser. No. 62/218,087, filed on Sep. 14, 2015, and entitled "Downhole Pump with Controlled Traveling Valve".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to downhole pumps. More particularly, the present invention relates to rod-type pumps in which a plunger is used so as to draw fluids through a standing valve and pass the fluids through a traveling valve so as to form a fluid column within the production tubing. More particularly, the present invention relates to downhole pumps in which the traveling valve is controlled during the movement of the plunger so as to facilitate the equalization of pressures within the production tubing while, at the same time, effectively removing sand accumulations from within the production tubing, within the barrel, and within the plunger.

2. Description of Related Art Including Information Disclosed Under 37 CFR 1.97 and 37 CFR 1.98.

Artificial lift refers to the use of an artificial means to increase the flow of fluids, such as crude oil, gas or water, from a production well. Generally, this is achieved by the use of a mechanical device inside the well (known as a pump) or by decreasing the weight of the hydrostatic column by injecting gas into the liquid some distance down the well. Artificial lift is needed in wells when there is insufficient pressure in the reservoir to lift the produce fluids to the surface, but often is used in naturally flowing wells to increase the flow rate above what would flow naturally. The produced fluid can be oil, water, or a mix of oil and water, along with produced fluids having some amount of gas.

Conventional oil and gas wells include a cased wellbore with a tubing string extending down to the hydrocarbon bearing formation. The casing is perforated at the production level to permit the hydrocarbons to flow into the casing and the bottom of the tubing is generally open to permit the hydrocarbons to flow into the tubing and up to the surface. Oftentimes, there is insufficient pressure in a formation to cause oil and other liquids and gases to readily flow to the surface. It therefore becomes necessary to install the artificial lift system so as to pump the fluids to the surface.

One of the most common types of artificial lift systems is a rod pump. This type of pump is positioned in the well at the level of the fluids to be removed and is mechanically driven by a series of rods connecting the pump to a pumping unit at the surface. These rod pumps include the simple combination of a cylinder or barrel with a piston or plunger and a suitable intake valve and a discharge valve. The intake valve is often referred to as a "standing valve" and the discharge valve is often referred to as a "traveling valve".

Two of the more common types of rod pumps are the tubing pump in which the pump barrel is attached directly to the tubing and is lowered to the bottom of the well as the tubing is run into the well. The plunger is attached to the bottom of the sucker rod that is positioned within the pump barrel. The intake valve is positioned at the bottom of the pump barrel and the traveling valve is positioned on the plunger. The second type of pump is often referred to as an insert pump and the entire assembly is attached to the bottom of the sucker rod. The barrel is held in place by special seating nipple or other device positioned within the tubing. This type of pump has the advantage that it can more easily be removed for repair or replacement than a tubing pump.

The operation of a rod pump is relatively simple. The plunger reciprocates up-and-down in the barrel under the force of the sucker rod. During the upstroke, the traveling valve is closed and the fluid above the plunger is lifted to the surface by the plunger and the sucker rod. At the same time, the standing valve is open so as to allow fluids to flow into and fill the now-evacuated barrel. On the downstroke, the standing valve is closed so as to trap the fluids in the barrel. The traveling valve is opened allowing the compressed fluids to flow through the plunger so that they can be lifted during the subsequent cycle.

While rod pumps have been in use for decades and have proven to be economical and reliable, they still experience certain shortcomings and problems. Some of these problems are associated with valves which are generally of the ball-and-seat variety. This type of valve is opened and closed by pressure differentials across the valve.

One problem that is often encountered is referred to as gas lock. This occurs when there is a substantial amount of gas that flows into the pump with the liquid. Because of the high compressibility of the gas, insufficient pressure is generated during the downstroke of the pump to open the traveling valve against the hydrostatic pressure of the fluid in the production tubing. Accordingly, the pump can repeatedly cycle without any fluid being lifted to the surface.

Fluid pound is another problem that is often encountered. If the barrel is only partially filled with liquid, the plunger forcefully encounters the liquid level part way through the downstroke so as to cause severe stress to be placed on the pump. Pump-off damage often occurs when the barrel is not completely filled with fluid. Damage occurs in the wall of the working barrel due to overheating of the pump which is caused by the absence of fluid to carry away the heat carried by friction in the pump. Additionally, fluid pound can cause a whipping action of the sucker rod so as to cause potential damage to the production tubing and damage to the sucker rod.

During the production of the formation fluid, mineral particles, often referred to as sand, may be swept into the flow path. The sand may erode production components, such as the downhole pump or sucker rod pump, the control valves on the surface, the ball-and-seat arrangement of the standing valve, etc. in the flow path. When substantial quantities of sand are carried along as oil and/or gas is removed from a formation, the sand can eventually plug the openings in the interior of the tubing by which the hydrocarbon production is withdrawn to the earth's surface. It is not uncommon for the pump itself to stick and/or the barrel to stick as a result of sand or other particulate matter becoming caught between the barrel and the plunger. The tolerances between the barrel and the plunger are close so as to effect a seal between the plunger and the barrel. If sand lodges therebetween, either the plunger or the barrel will be cut or the plunger sticks in the barrel. The structure of such pumps makes them particularly prone to such damage because such pumps rely on a seal which is formed between the plunger and barrel by the leading edge of the plunger.

Generally, when the pump becomes "sanded in" in the production tubing, a very complicated procedure is required so as to remove the sanded-in components of the well. Typically, the production tubing would have to be removed so as to separate the pump from the tubing and remove the sand accumulation. As such, is important that sand the removed from the interior of the production tubing and from the interior of the barrel so as to prevent these problems from occurring.

Typically, such rod pumps do not operate at very well in association with multi-phase fluids are with gas wells. In multi-phase fluids, there can be a gas and a liquid, such as oil or water. In gas wells, typically, the multi-phase liquid will include gas, water and light oil. Because of the high percentage of gas in such wells, the problems associated with gas locks and/or liquid pounding occur more frequently.

Currently, there is a strong trend toward horizontal or deviated wells. Such rod pumps are not particularly effective in pumping the fluid in such deviated or horizontal wells. This is because the sucker rod will have to travel in a similar pattern to that of the deviated wells. In certain circumstances, the deviated well can have a convoluted or S-shaped configuration. As such, it is very difficult for the rod to effectively reciprocate upwardly and downwardly in such deviated wells. Furthermore, when sucker rods are used in such deviated wells, they can rub against the side of the production tubing so as to eventually perforate the production tubing in areas that are not desired. The frictional contact between the rod in the inner wall of the production tubing can further potentially damage the sucker rod such that the well will need to be repaired by pulling the production tubing and replacing the damaged tubing or by pulling the sucker rod and replacing the damaged section of the sucker rod. Once again, this could lead to an extended period of non-productivity of the well.

In the past, a variety of patents have issued relating to such rod pumps. In particular, U.S. Pat. No. 2,344,786, issued on Mar. 21, 1944 to Patterson et al., describes an anti-pound pump pressure equalizer. This anti-pound pump has a working chamber between the standing and traveling valves. A means is exposed at one side to the working chamber pressure and is yieldable in one direction in accordance with rising pressure in the working chamber during each discharge stroke of the pump. A chamber is formed that is isolated from the rising pressure. The yielding means is positionable during the course of the yielding movement for opening the working chamber of the pump into pressure-equalizing communication with the production column independent of the traveling valve of the pump. A means is provided for returning the yieldable means to an interactive position subsequent to pressure equalization.

U.S. Pat. No. 4,599,051, issued on Jul. 8, 1986 to H. L. Spears, discloses a traveling valve assembly for a fluid pump. This traveling valve assembly includes a ball valve actuator which engages the ball valve during the downstroke of the sucker rod to force the ball open into an open fluid transmitting relationship with respect to the valve seat.

U.S. Pat. No. 4,691,735, issued on Sep. 8, 1987 to J. B. Horton, shows a plunger valve apparatus for an oil well pump. The traveling valve or standing valve for the pump includes a piston which lifts the ball above the valve seat to open the valve and sets the ball back on to the seat to close the valve. The ball is contained within a ball protection shield which prevents uncontrolled movement by the ball inside a middle tube. The piston has openings and the ball protection shield has apertures which allow fluid to flow through the valve without engaging the ball.

U.S. Pat. No. 4,708,597, issued on Nov. 24, 1987 to A. V. Fekete, describes a plunger with a simple retention valve. The fluid pump has a plunger reciprocating within a working cylinder and a standing intake retention valve. The plunger includes a stem having a plug and a stop affixed to it. The plunger also has a body that is slidably engaged to the cylinder and located on the discharge side of the plug and on the intake side of the stop. Upon the upstroke of the plunger, a plug surface engages with a sealed body and therefore pumps the fluid before it. Meanwhile, fluid flows in behind the plunger through the standing intake retention valve. On the downstroke, the plug disengages from the body so as to allow fluid to flow noncompressibly past the plunger.

U.S. Pat. No. 4,741,679, issued on May 3, 1988 to D. L. Blassingame, discloses an oil well traveling valve for a sucker rod-operated oil pump. This traveling valve includes a fluid outlet ported pump head connecting inner and outer sleeves with the upper end of a working barrel for reciprocating the working barrel. A valve is tethered within the inner sleeve in a manner ensuring separation of the valve from its seat for opening the pump fluid passageway and exhausting gas from the pump bore with each complete sucker rod stroke.

U.S. Pat. No. 4,781,543, issued on Nov. 1, 1988 to G. M. Sommer, teaches an artificial lift system for oil wells in which oil is recovered from an underground formation more efficiently by the use of a subsurface power piston that reciprocates a subsurface pump. A series of connecting rods connects the power piston to the subsurface pump. The subsurface power piston is driven upwardly by a surface-mounted hydraulic actuation system. The distance between the subsurface pump and the power piston is set so that pressure at the depths of the power piston and pump closely counterbalance the weight of the sucker rod string at all positions of the stroke with a slight down bias.

U.S. Pat. No. 4,781,547, issued on Nov. 1, 1988 to R. D. Madden, shows a gas equalizer for a downhole pump. This gas equalizer device is intended to avoid the fluid pounding condition. The gas equalizer device includes a pushrod having a marginal end reciprocatingly enclosed in a slidable manner within a housing which is mounted to the usual traveling valve cage of the downhole pump. The push rod is alternately moved from an extended to a retracted position each upstroke and downstroke of the pump. The free terminal end of the push rod is arranged to engage the ball check valve of the traveling valve assembly as the pump commences the downstroke. This unseats the ball so as to allow any accumulated gases to escape from the variable pump chamber. The escape gases flow out of the pump and up the tubing string along with the produced fluid.

U.S. Pat. No. 4,867,242, issued on Sep. 19, 1989 to G. E. Hart, discloses a method and apparatus for breaking a gas lock in an oil well pump. This apparatus includes a stationary barrel with a standing valve on the bottom, a reciprocating piston in the barrel with a traveling valve on the bottom of the piston, and an unseating rod positioned above the standing valve and adapted to protrude into the traveling valve to unseat the ball closure thereof near the bottom extremity of the downstroke of the piston.

U.S. Pat. No. 4,907,953, issued on Mar. 13, 1992 Hebert et al., teaches a locking gas equalizer for use with a subsurface pump for lifting fluids having a high gas content. A mechanical lifting piston and rod are slidably mounted beneath the check valve in the traveling pump assembly. When the pump reaches the bottom of its downstroke, the piston raises the rod and unseats the check valve. As the pump cycle reverses at the top of the stroke, the inertia of the piston also causes the rod to be raised for unseating the check valve and allowing a small amount of fluid to drop into the pump chamber. As a result, gas pressure within the pump chamber volume is positively equalized to prevent gas lock of the pumping action.

U.S. Pat. No. 5,407,333, issued on Apr. 18, 1995 to C. T. Lambright, discloses a rod-driven downhole pump. The pump includes a traveling barrel contained within a pump housing, a central pump rod extending axially within the barrel, a valve ball located at the lower end of the pump rod, and a valve seat near the barrel lower end. The pump rod includes a rod shoulder for engaging the upper end of the barrel. The barrel contains annular passageways for the flow of fluid through the barrel. The pump rod is reciprocable within the barrel and the barrel is reciprocable within the pump housing. The downward stroke of the pump rod causes the rod shoulder to engage the barrel's upper end and concurrently displaces the ball valve below the valve seat so as to allow environmental fluid to flow through the annular passageways of the barrel. On the upstroke of the pump rod, the valve ball engages the valve seat and pushes the pump barrel upwardly within the pump housing.

U.S. Pat. No. 5,139,398, issued on Aug. 18, 1992 to T. R. Downing, provides a neutralizer valve for a downhole pump. This neutralizer valve is for use in conjunction with one or more reciprocating pumps. The neutralizer valve takes the place of a regular traveling valve and a rod pump. The neutralizer valve includes a drag plunger for passing a crude and natural gas mix therethrough on a downstroke of the tubing string. The neutralizer valve includes a guide barrel that is connected into the rod pump plunger and contains a ported seal stem that is arranged to move up-and-down therein. The ported seal stem includes a keyed rod at its upper end that is to travel up-and-down in a keyway that is formed through a ported disc which is arranged across the guide barrel interior. On an up-stroke of the rod tubing string, the valve closes so as to create a void between it and a standing valve of a downhole pump. On the downstroke, the stem collar valve face is moved off the seat so as to open the valve to allow a fluid to flow therethrough.

U.S. Pat. No. 5,141,411, issued on Aug. 25, 1992 to J. H. Klaeger, discloses a center-anchored rod-actuated pump which is particularly useful in deep and/or low-pressure stripper wells. The pump includes a traveling valve and a standing valve. The traveling valve is provided with a valve member which includes a downwardly extending stem which terminates in a lower bearing surface. The standing valve is provided with a valve member having an upper bearing surface. As the plunger of the pump is reciprocated, the lower bearing surface of the valve member of the traveling valve mounted therein contacts the upper bearing surface of the valve member of the standing valve when the plunger is near the maximum extent of downward travel so as to force the traveling valve open and/or force the standing valve closed depending upon fluid pressure conditions and whether the standing valve is stuck open.

U.S. Pat. No. 5,628,624, issued on May 13, 1997 to J. A. Nelson, discloses an assembly for unseating a seated traveling valve ball. The assembly includes a tubular member having therein a piston with an actuator for engaging the ball. Mechanical advantage is provided either by providing a sealing area of the piston that is greater than the sealing area of the seat valve and/or by providing an engaging member suitable to strike the seated ball asymmetrically with respect to the vertical axis through the center line of the ball.

U.S. Pat. No. 5,829,952, issued on Nov. 3, 1998 to D. W. Shadden, provides a reversible valve ball assembly for use in a downhole pump check valve. The reversible valve ball can be removed, inverted and reinserted into the check valve to provide a new valve ball sealing surface. The reversal of the valve ball is performed after the original valve ball sealing surface has worn and deteriorated so that it can no longer seat properly to form a seal between the valve ball surface and a valve seat. A set of irregularly-shaped valve ball guide arms are provided which rotate within valve guide apertures to provide a clean action between the valve guide apertures and the valve ball arms to prevent accumulation of debris. An elongated gas-breaker fin is provided so as to prevent a gas lock. The gas-breaker fin enables a reduced vertical length for the valve ball arms so that a reversible symmetric valve ball assembly can be utilized.

U.S. Pat. No. 6,481,987, issued on Nov. 19, 2002 to M. B. Ford, discloses an improved traveling valve that has a valve positioned on a seal stem so that the ball is reliably centered when seated on the valve seat. The traveling valve is constructed so that a lower portion of the valve rotates during pumping so as to impart rotational movement of the fluid passing therethrough. The rotational movement is caused by angled channels in an interior portion of a vane and the rotator positioned at the bottom of the traveling valve so as to work in combination with the angled channels in the seal stem.

U.S. Pat. No. 7,051,813, issued on May 30, 2006 to Hayes et al., shows a pass-through valve and stab tool. This tool allows periodic access through one or more one-way of valves installed in a fluid flow stream. Fluid can flow through the bypassed valves or through the tools used to bypass the valves in the manner of a reciprocating production pump. A stab tool cooperates with a valve to unseat a ball from a ball seat so as to bypass the ball and pass through the ball seat. The stab tool is conveyed by tubing for discharge of fluid through ports in the stab tool. A rod is installed within a pump between a reciprocating uphole valve and a downhole valve is arranged so that when the pump is closed, the stab tool at the rod's lower and passes through the downhole valve and a projection at the rod's upper end passes through the uphole valve such that the pump is partially closed.

U.S. Pat. No. 7,878,767, issued on Feb. 1, 2011 to M. B. Ford, describes a cyclonic debris-removing valve. The ball valve is capable of transitioning between an open position and a closed position. The ball valve includes a hydraulic piston, a containment union, a ported stem, a containment cage, and a drag plunger. The ball valve is adapted to regulate the flow of fluid northward through the valve. During a pump downstroke, fluid enters the drag plunger, moves northward through the containment cage and into the interior of the ported stem, exits the interior of the ported stem and enters a plurality of angled vanes so as to impart cyclonic motion on fluid passing northward therethrough so as to assist in the removal of debris. During the downstroke, a pedestal portion of the hydraulic piston unseats the ball from the seat.

U.S. Patent Application Publication No. 2005/0053503, published a Mar. 10, 2005 to R. D. Gallant, describes an anti-gas-lock pumping system. The pump is designed such that any gas present in the fluid that is pumped is completely displaced from the pumping chamber with each downstroke of a pump plunger.

U.S. Patent Application Publication No. 2013/0025846, published on Jan. 31, 2013 to G. Scott, teaches an apparatus for use with the traveling valve assembly of a downhole pump for releasing gas and so as to prevent gas locks. The apparatus comprises a piston slidably disposed within a cylindrical housing. The piston is driven by an attached plunger element. On the downstroke of the pump, the piston protrudes through an end of the cylindrical housing so as to engage and open the adjacent valve. On the upstroke of the pump, the piston retracts into the cylindrical housing so as to disengage from the valve and to allow the valve to close. Fluid flows along the outer surface of the apparatus by means of fluid ports connected by defined fluid passages.

U.S. Pat. No. Re 33,136, reissued on Feb. 13, 1990 R. D. Madden, describes a gas equalizer device for use in conjunction with a reciprocating pump located downhole within a wellbore. The gas equalizer device includes a pushrod having a marginal end reciprocatingly enclosed in a slidable manner within a housing which is mounted to the usual traveling valve cage of the downhole pump. The push rod is alternately moved from an extended position to a retracted position on each upstroke and each downstroke of the pump. The free terminal end of the pushrod is arranged to engage the ball check valve of the traveling valve assembly as the pump commences the downstroke. This unseats the ball so as to allow any accumulated gases to escape from the variable pump chamber.

It is an object of the present invention provide a downhole pump system with higher system efficiencies.

It is another object of the present invention to provide a downhole pump system that has greater operational capabilities.

It is another object of the present invention to provide a downhole pump system that has lower operating costs.

It is still another object of the present invention to provide a downhole pump system that maximizes hydrocarbon production.

It is another object of the present invention to provide a downhole pump system that avoids gas locks.

It is a further object of the present invention to provide a downhole pump system that operates in horizontal and/or highly-deviated production tubing.

It is another object of the present invention to provide a downhole pump system that is able to able to produce at low rates and at high pressures.

It is another object of the present invention to provide a downhole pump system that is operable at extended depths and high temperatures.

It is still another object of the present invention to provide a downhole pump system that effectively remove solids from the fluid during the production.

It is another object of the present invention provide a downhole pump system that provides extended runtime.

It is still a further object of the present invention to provide a downhole pump system that has reduced sensitivity to solids plugging.

It is another object of the present invention to provide a downhole pump system that reduces rod buckling stress and reduces the problems associated with deviated rods.

It is still another object of the present invention to provide a downhole pump system that maximizes pump fillage.

It is still another object of the present invention provide a downhole pump system that avoids ball dance damage.

It is still a further object of the present invention to provide a downhole pump system that minimizes fluid pound and the problems resulting from fluid pound.

These and other objects and advantages of the present invention will become apparent from a reading of the attached specification and appended claims.

BRIEF SUMMARY OF THE INVENTION

The present invention is a fluid pump for an artificial lift system. The fluid pump includes a barrel, a standing valve located at a lower end of the barrel, a plunger reciprocatingly mounted within the barrel, and a traveling valve incorporated within the interior of the plunger so as to control fluid flow through the plunger.

The barrel of the present invention includes a first wide inner diameter section, a second wide inner diameter section, and a reduced inner diameter section between the first wide inner diameter section and the second wide inner diameter section. The barrel includes an opening at the top thereof and an opening at the bottom thereof.

The standing valve is positioned within the barrel at the opening at the bottom of the barrel. The standing valve is movable between an open position and a closed position. The open position allows fluid to flow into an interior of the barrel. In particular, the bottom end of the barrel includes an aperture formed therein. The standing valve has a flat surface at the top thereof located within the interior of the barrel and has a stem extending downwardly from this flat surface. The stem extends through the aperture at the bottom of the barrel.

The plunger includes a wide diameter section and a narrow diameter section. The narrow diameter section is located above the wide diameter section. A first aperture is provided at the top of the plunger so as to extend into an interior of the plunger. A second aperture opens to the sidewall of the plunger so as to open to the interior of the plunger. A channel extends longitudinally so as to open at the bottom of the plunger from a central chamber located within the interior of the plunger. A rod extends from the top of the plunger. This rod can be connected to a sucker rod associated with the pump mechanism. A first shoulder is formed in the central chamber of the plunger and located below the first aperture and above the second aperture. This first shoulder provides a seating area for the traveling valve.

The traveling valve has a head portion having a diameter suitable for seating on the shoulder of the plunger. The traveling valve includes a body that is connected to the head portion. The body is adapted for slidable movement within the interior of the plunger. The body has a fluid passing channel therein so as to open at an exterior of the body. The body also includes a tubular member having an outer diameter less than an inner diameter of the channel of the plunger. As such, this tubular member can be slidable within the channel. A spring is mounted to the plunger and to the traveling valve so as to urge the traveling valve into sealing relationship with the shoulder of the plunger.

An upper pipe can be connected to the top of the barrel. The upper pipe can be secured, by conventional means, to the production tubing.

The traveling valve is movable to a first position in which the fluid above the plunger passes through the first aperture into an interior of the plunger, passes through the fluid-passing channel of the body, and passes through the tubular member so as to pass into the interior of the barrel below the bottom of the plunger. As such, the serves to equalize pressure of the fluid above the plunger and below the plunger. The traveling valve is also movable to a position such that the narrow inner diameter section of the barrel bears against the wide diameter portion of the plunger such that a compression chamber is formed in an area between the narrow diameter section of the plunger and the wide inner diameter section of the barrel. An upper end of the narrow diameter section of the plunger is in sealing relationship with the inner diameter of the upper pipe. The compressed fluid in the compression chamber flows through the second aperture of the plunger so as to urge the traveling valve upwardly and pass the compressed fluid through the interior of the plunger below the traveling valve and through the tubular member so as to flush sand therefrom.

The traveling valve is also movable to an upper position such that the wide diameter section of the plunger is spaced from the narrow inner diameter section of the barrel such that the compressed fluid from the compression chamber is released toward the interior of the barrel and toward the bottom of the plunger so as to flush sand from the inner wall of the barrel and the outer wall of the plunger. A bottom of the tubular member is spaced from the channel of the barrel such that compressed fluid from the compression chamber passes through the channel of the barrel so as to flush sand from the channel of the barrel. In this arrangement, the standing valve is unseated.

The plunger is also movable to a lower position at the bottom of the stroke such that the traveling valve is in seated relationship with the shoulder of the plunger such that the fluid above the plunger can flow through a space between the narrow diameter section of the plunger and the second wide inner diameter section of the barrel so as to equalize pressures above and below the plunger. The tubular member of the traveling valve is in sealing relationship with the tubular member of the barrel.

This foregoing Section is intended describe, with particularity, the preferred embodiments of the present invention. It is understood that modifications to these preferred embodiments can be made within the scope of the appended claims. As such, the Section should not be construed, in any way, as limiting of the broad scope of the present invention. The present invention should only be limited by the following claims and their legal equivalents.

DETAILED DESCRIPTION OF THE INVENTION

Figure 1:
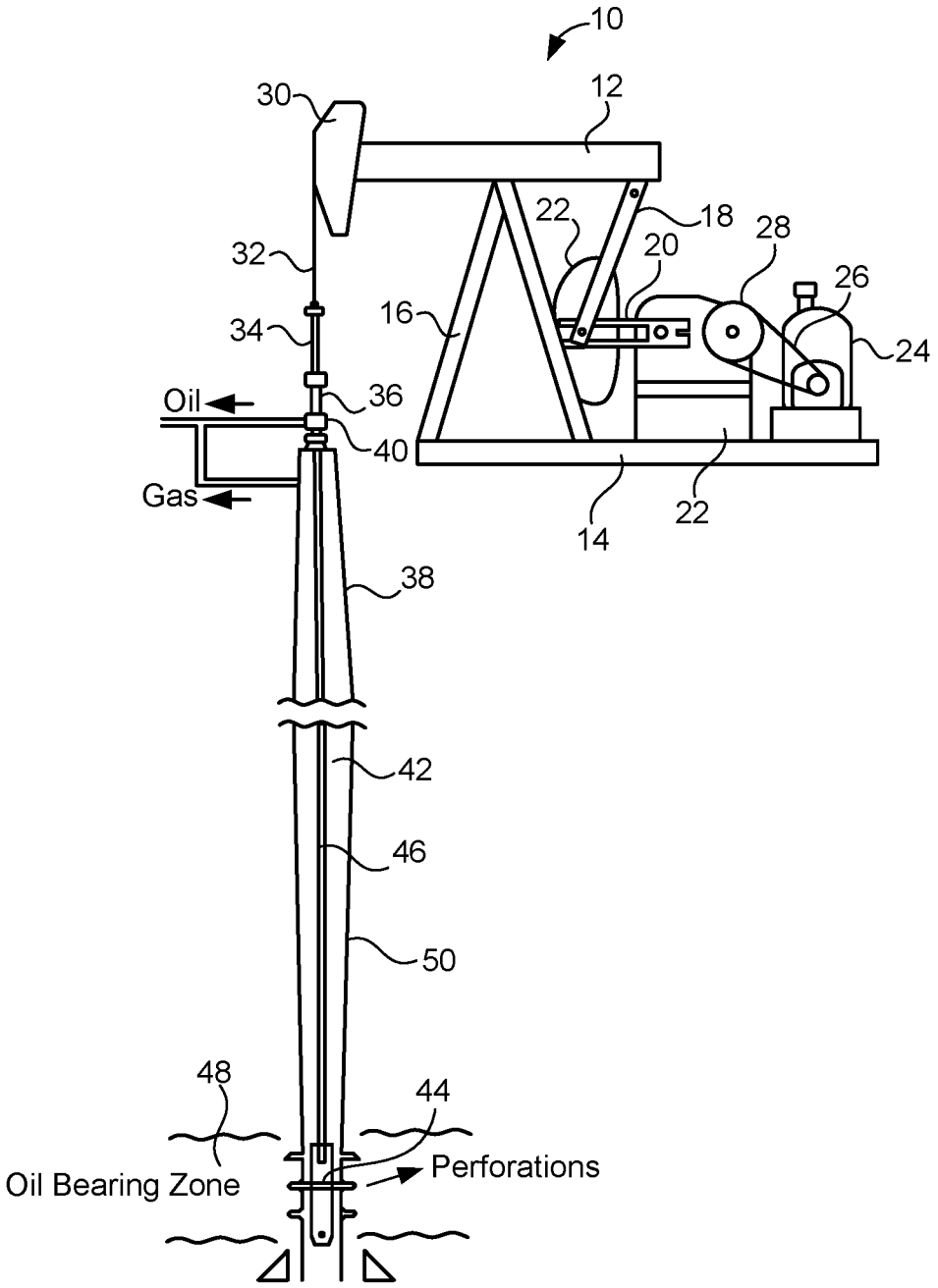
FIG. 1 PRIOR ART
FIG. 1 is a diagrammatic illustration of a conventional rod pumping system of the prior art.

Referring to FIG. 1, there is shown a pumping system 10 in accordance with the prior art. The pumping system 10 is a reciprocating rod-type pumping system. In particular, the pumping system 10 includes a walking beam 12 that is supported above a base 14 by a samson post 16. The walking beam 12 is mounted for pivoting movement with respect to the top of the samson post. A pitman arm 18 is affixed to one end of the walking beam 18 and is engaged with a crank 20. A counterweight 22 is cooperative with the pitman arm 18 and with the end of the walking beam 12. A gear reducer 22 is cooperative with a motor 24. A V-belt 26 extends from a sheave associated with the motor 24 to a sheave 28 associated with the gear reducer 22. The motor 24 will cause a rotation of the sheave so that the V-belt 26 will cause the sheave 28 to rotate. This, in turn, causes a reciprocal movement of the crank 20 and the counterweight 22 so as to cause the walking beam 12 to pivot upwardly and downwardly.

A horsehead 30 is mounted to an opposite end of the walking beam 12. A bridle 32 extends downwardly from the horsehead 30 and is joined to a polished rod 34. Polished rod 34 extends through stuffing box 36 and downwardly into the well 38. There is a tee 40 at the top of the well 38 which allows oil and gas to be transmitted from the interior of the production tubing 42 located within the well 38.

A downhole pump 44 will be located at the end of a sucker rod 46. Sucker rod 46 extends through the interior of the production tubing 42. As a result, the reciprocating movement of the walking beam 12 will cause the sucker rod 46 to move upwardly and downwardly and will cause the downhole pump 44 to move upwardly and downwardly so as to draw fluids through the production tubing 42. It can be seen that the downhole pump 44 is located within an oil-bearing zone 48. Various perforations are formed in the casing 50 in the area of the production zone 48 so as to allow fluids to pass into the casing 50 and around the production tubing 42. Ultimately, the accumulation of fluids within the annulus between the production tubing 46 and the casing 50 will flow so as to be drawn by the downhole pump upwardly for discharge at the surface.

Figure 2:
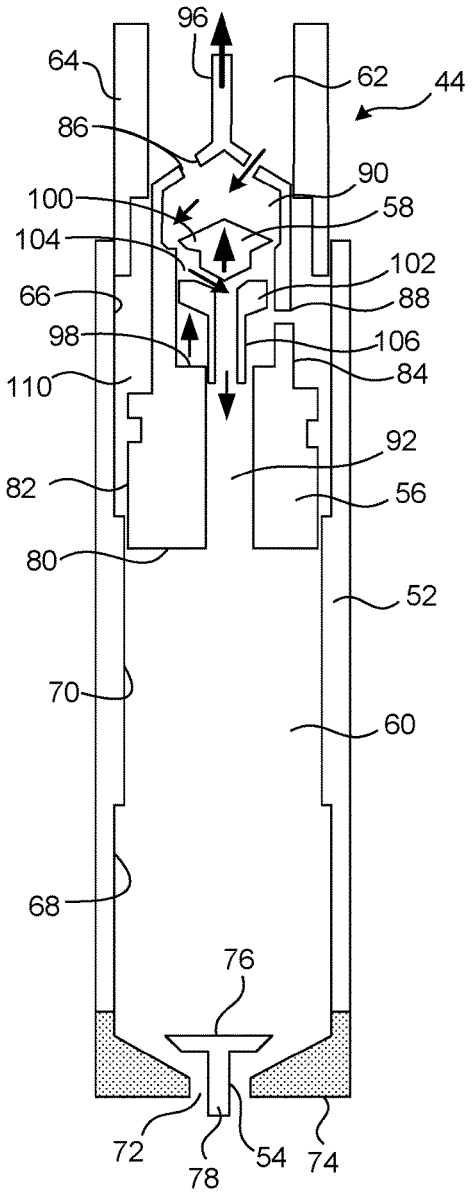
FIG. 2 is a cross-sectional view of the downhole pump system of the present invention with the plunger in an upstroke position.

FIG. 2 illustrates a detailed view showing the downhole pump 44. This downhole pump 44 includes a barrel 52, a standing valve 54, a plunger 56, and a traveling valve 58. Each of these elements cooperate so as to cause the downhole pump 44 to compensate for fluid pressures in the interior 60 of the barrel 52 below the plunger 56 and for pressures within the interior 62 of the upper pipe 64 (and the fluid column thereabove).

The barrel 52 includes a first wide interior diameter section 66, a second wide interior diameter section 68 and a reduced interior diameter section 70. The reduced interior diameter 70 is located between the first wide interior diameter section 66 and the second wide interior diameter section 68. The barrel 52 includes an opening at the top thereof and an opening 72 at the bottom thereof. In particular, the barrel 52 has a narrowed bottom end 74 that will define the opening 72.

The standing valve 54 is located at the bottom opening 72. In normal use, the standing valve 54 will be movable between an open position and a closed position. In the open position (as shown in FIG. 2), the standing valve 54 can allow fluids from the formation to flow upwardly into the interior 60 of the barrel 52. The standing valve 54 includes a flat top surface 76 and a stem 78 that extends downwardly through the opening 72. The flat top surface 76 is particularly configured such that if the bottom 80 of the plunger 56 should contact the standing valve 54, any forces will be distributed across the flat surface 76. As such, the problems associated with ball-type standing valves are reduced. In other words, if the bottom 80 of the plunger 56 would contact the ball positioned at the opening 72, the force of contact could tend to deform the ball. This would result in an uneven seating of the ball within the opening 72.

Figure 6:
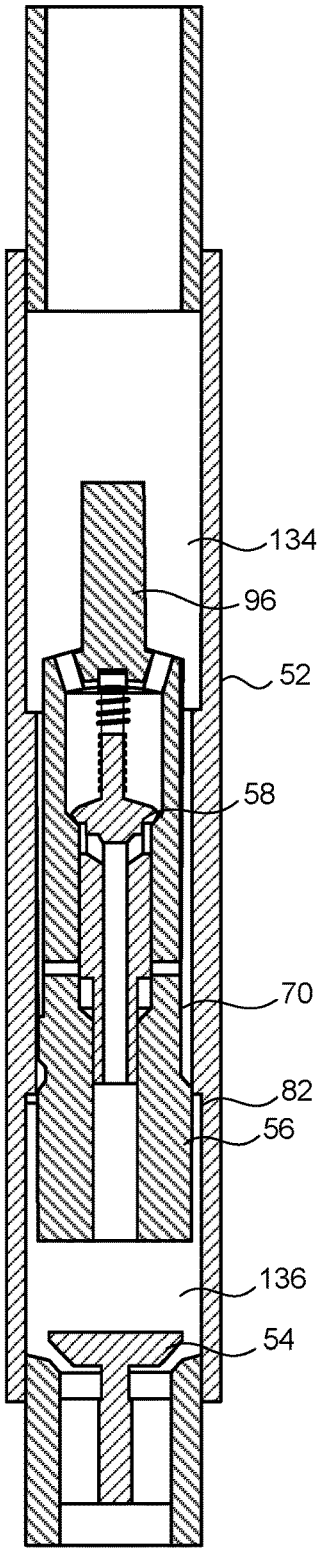
FIG. 6 is a cross-sectional view of the downhole pump system of the present invention showing the plunger in an initial upstroke position.

The plunger 56 includes a wide diameter section 82 and a narrow diameter section 84. The narrow diameter section 84 is located above the wide diameter section 82. A first aperture 86 is formed at the top of the plunger 56. A second aperture 88 is formed through the sidewall of the plunger 56 so as to open into a volume 90 located within the interior of the plunger 56. A channel 92 has one end opening to the interior 90 of the plunger 56 and opposite end opening at the bottom 80 of the plunger 56. The channel 92 extends longitudinally through the plunger 56. A rod 96 is connected to the top of the plunger 56 and extends upwardly. This rod 96 can be connected to the sucker rod 46 of the pumping system. The plunger 56 also includes a shoulder 98 at a bottom of the interior 90 and generally above the wide diameter section 82. The seating area for the traveling valve 58 (as seen in FIG. 4) at the bottom chamber 90 (as shown in FIG. 6).

Figure 4:
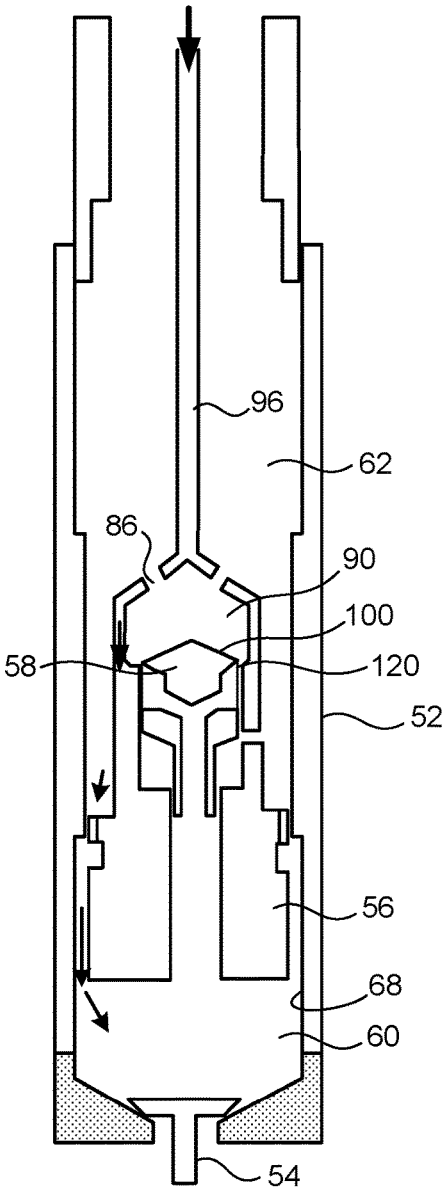
FIG. 4 is a cross-sectional view of the downhole pump system of the present invention showing the plunger in a downstroke position.

The traveling valve 58 includes a head 100 having a diameter suitable for seating on the shoulder 120 (as shown in FIG. 4). This head 100 has an inverted V-shape configuration so as to provide a funnel-like effect for fluid flowing thereby. A body 102 is connected to the head 100 of the traveling valve 58. The body 102 is adapted for slidable movement within the interior 90 of the plunger 56. The body has a fluid-passing channel 104 so as to open at the exterior of the body 102. The body 102 also includes a tubular member 106 extending downwardly therefrom. The tubular member 106 has an outer diameter that is less than an inner diameter of the channel 92 of the plunger 56. As will be described hereinafter, a spring can be mounted to the head 100 of the traveling valve 58 so as to urge the head 100 downwardly toward the shoulder 120 of the plunger 56.

In FIG. 2, it can be seen that the plunger 56 is in an upper position. Importantly, this upper position will define a compression chamber 110. The compression chamber 110 is formed between the first wide inner diameter section 66 of the barrel 52 and the outer surfaces of the plunger 56. In particular, it can be seen that the wide diameter section 82 of the plunger 56 will be in close relationship to the narrow inner diameter section 70 of the barrel 52. In generally, this is in a sealed relationship. The compression chamber 110 is also defined between the narrow diameter section 84 of plunger 56 and the wide diameter section 82 of plunger 56. The narrow diameter portion 84 of the plunger 56 extends upwardly so as to have an upper end generally in sealing relationship with an inner wall of the upper pipe 64. In this position, fluids located within the compression chamber 102 are suitably compressed.

Importantly, the compressed fluid within the compression chamber 110 can flow only through the second aperture 88. This force urges the body 102 of the traveling valve 58 upwardly so as to unseat the head 58 from the interior of the plunger 56. As a result, fluids located within the interior 62 of the upper pipe 64 can flow through the first aperture 86 (as indicated by the arrows), around the head 100 of the traveling valve 58, through the channel 104 of the traveling valve 58 and downwardly through the tubular member 106. These fluids will then flow downwardly through the channel 92 in the plunger 56 so as to enter the interior 90 of the barrel 52. The compressed fluid from the compression chamber 110 will also flow through the second aperture 88 and downwardly through the space between the tubular member 106 of the traveling valve 58 and within the channel 92 of the plunger 56. The flow of the fluid serves to equalize pressure between the top and bottom of the plunger 56. The compressed fluid passing therethrough can serve to remove debris, such as sand, scale, calcium carbonate, iron sulfide, and other materials from the working surfaces associated with the barrel 56. As such, the present invention effectively provides a "flushing action" so as to remove the sand, while, at the same time, equalizing pressures within the barrel 52. Also, the friction movement in the fluid participates in this flashing action. The contribution of the compressed volume and the friction movement will depend on the composition of the fluid (i.e. the gas quantity).

Figure 3:
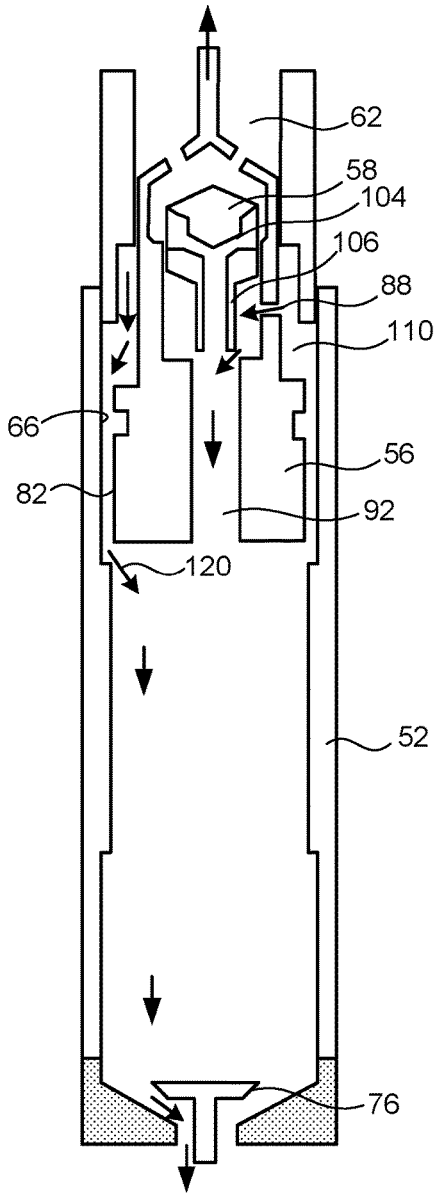
FIG. 3 is a cross-sectional view of the downhole pump system of the present invention with the plunger in an uppermost upstroke position prior to beginning a downstroke.

FIG. 3 illustrates the plunger 56 in an upper position. In this upper position, the compression chamber 110 is opened so as to allow the compressed fluids to flow outwardly (as indicated by arrow 120) from the compression chamber through the spaces between the wide diameter section 82 of the plunger 56 and the first wide inner diameter section 66 of the barrel 52. As such, during the further upstroke of the plunger 56, these fluids can further be used so as to flush sand from the outer surfaces of the barrel 56 and from the inner wall of the barrel 52. As can further be seen, the compressed fluids will continue to flow until the wide diameter section 82 of the plunger 56 passe out of the bore 70 of the barrel, as shown by arrow 120. Once the plunger passes outwardly of the bore 70, the traveling valve 58 moves in a downward direction. Once again, this serves to equalize pressure and also provide a force which causes sand to be evacuated from the interior of the plunger 56 and from the interior of the barrel 52. Since the standing valve 76 is in an closed position, the gas, fluid and sand can be passed outwardly of the barrel 52. As a result, sand is effectively removed from the pump 44 of the present invention.

Figure 5:
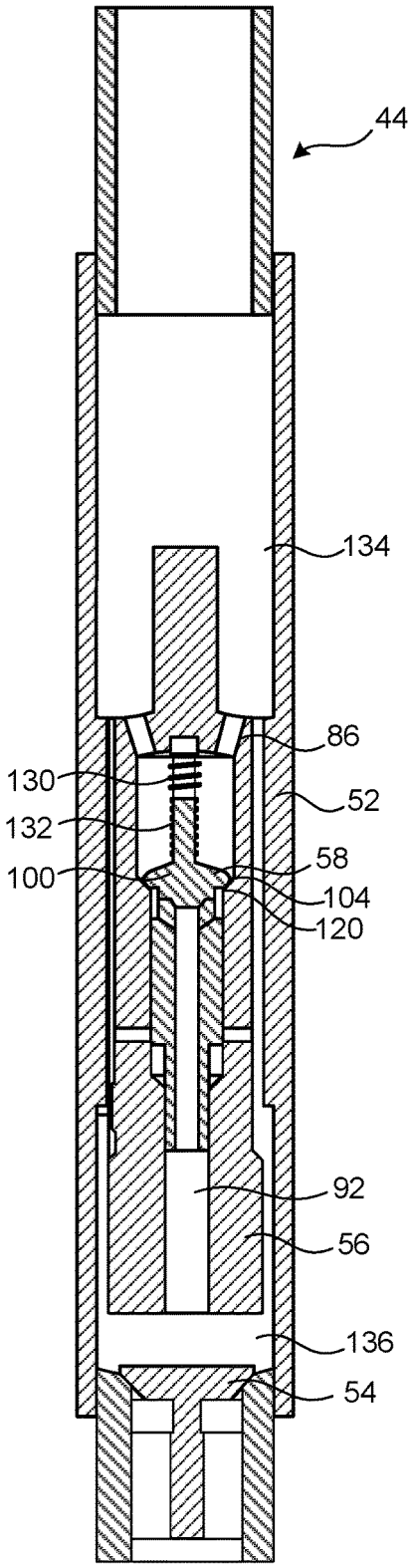
FIG. 5 is a cross-sectional view of the downhole pump system of the present invention at the end of the downstroke and at the start of the upstroke.

In FIG. 5, it can be seen that the head 100 of the standing valve 58 being seated upon the shoulder 120 within the interior 90 of the traveling valve 58. The seating of the head 100 (as shown in FIG. 6) upon the shoulder 120 serves to prevent further fluid flow from the interior 62 above the barrel 56 through the apertures 86. So as to equalize pressure, the fluid in the interior 62 can flow around the exterior of the plunger 56 and downwardly into the interior 60 below the plunger 56. In this configuration, the standing valve 54 is closed. Additionally, as can be seen, there is no compression chamber since the outer surfaces of the plunger 56 are in spaced relationship to the second wide inner diameter section 68 of the barrel 52.

Following this downstroke position, the piston 56 can be moved upwardly so as to once again create the compression chamber and to carry out the movement of fluids in the manner described herein before in association with FIGS. 2 and 3.

FIG. 5 is a detailed view of the pump 44 of the present invention. As stated hereinbefore, the pump 44 includes a barrel 52, a plunger 56, a standing valve 54 and a traveling valve 58. In FIG. 5, it can be seen that there is a spring 130 that is provided so as to urge the traveling valve 58 into a seated position adjacent to the shoulder 120 of the plunger 56. Spring 130 serves to prevent any rattling of the valve 58 during its movement. In FIG. 5, the head 100 of the standing valve 58 includes a rod-like portion 132 which extends upwardly therefrom and which is received by the spring 130.

In particular, FIG. 5 illustrates the pump 44 in which the plunger 56 is at the end of the downstroke and the start of the upstroke. In this configuration, the standing valve 54 is closed and the traveling valve 58 is lightly open. In this configuration, the plunger 56 is uncovered. The above plunger area 134 and the below plunger area 136 are connected so as to communicate with each other through the channel 92, through the channel 104 and through the apertures 86.

FIG. 6 shows the plunger 56 at the beginning of the upstroke. In FIG. 6, the standing valve 54 is opened so as to allow fluids to be drawn into the below the plunger area 136. The standing valve 54 will remain open until the plunger 56 is at the position illustrated in FIG. 7. The standing valve 54 should be open as large as possible so as to facilitate solids evacuation. In the position shown in FIG. 6, the plunger 56 is covered. The below piston area 136 and the above piston area 134 are separated since the traveling valve 58 is closed and since the wide diameter section 82 of the plunger 56 will bear against the narrow inner diameter section 70 of the barrel 52. In this configuration, the above plunger area 134 will have a greater pressures than the below plunger area 136. As a result, the rod 96 will be moved under tension. As a result, fluids are drawn from the annulus into the barrel 92 and, in particular, into the below plunger area 136.

Figure 7:
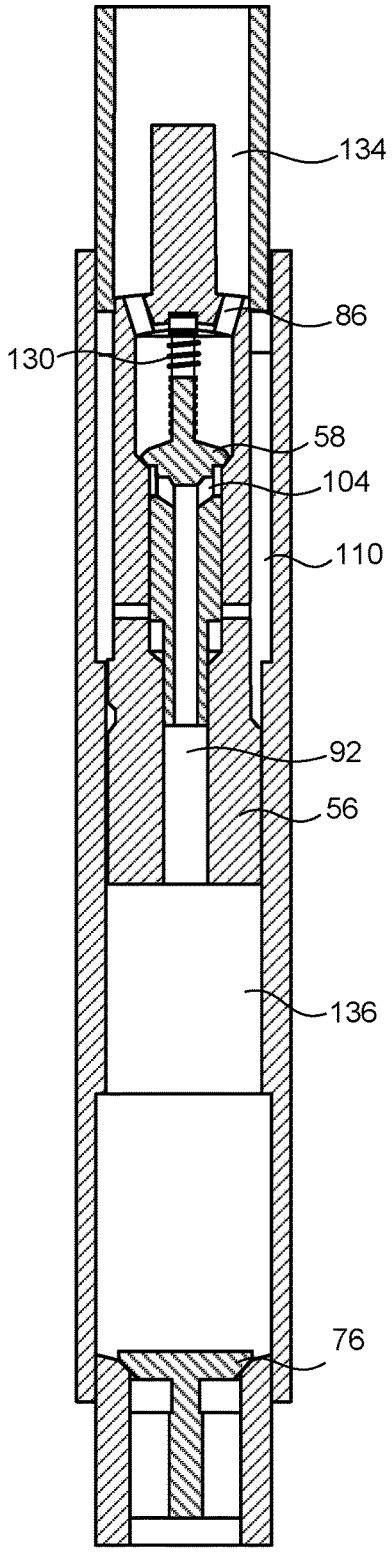
FIG. 7 is a cross-sectional view of the downhole pump system of the present invention showing the plunger in an upper upstroke position.

FIG. 7 shows an upward upstroke position of the plunger 56. There is an accumulation of fluid within the below plunger area 136. In this position, the compression chamber 110 is formed in the manner described herein previously. The continued upward movement of the plunger 56 will further serve to compress the volume of fluid within the compression chamber 110. In this position, the traveling valve 58 is moved upwardly by the pressures within the compression chamber 110. As such, the channel 104 is properly opened. These forces will urge against the resistance of the spring 130. The traveling valve 58 is thereby opened and uncovered. The above plunger area 134 is connected to the below plunger area 136 in the manner described hereinbefore. In particular, these are connected through the channel 92, through the channel 104 and through the aperture 86. In this position, pressures are equalized. In particular, the pressure fluid column in the above plunger area 134 is transmitted to the below plunger area 136. The traveling valve 76 is illustrated as closed.

Figure 8:
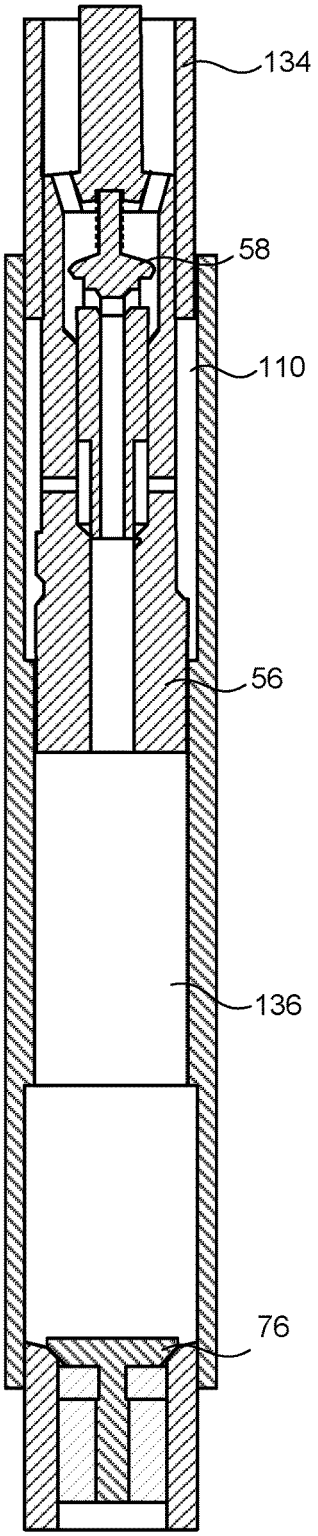
FIG. 8 is a cross-sectional view of the downhole pump system of the present invention showing the plunger in a further upstroke position.

FIG. 8 illustrates the plunger 56 in a further upstroke position. It can be seen that the flow through the traveling valve 58 helps to evacuate solids from the interior of the plunger, in the manner described herein previously. The above plunger area 134 and the below plunger area 136 remain connected. The above plunger area 134 and the below plunger area 136 are balanced with the pressure fluid column. In this configuration, the fluid within the compression chamber 110 is further compressed so as to flow through the interior of the plunger 56 in the manner described herein previously. In this configuration, the standing valve 76 remains closed.

Figure 9:
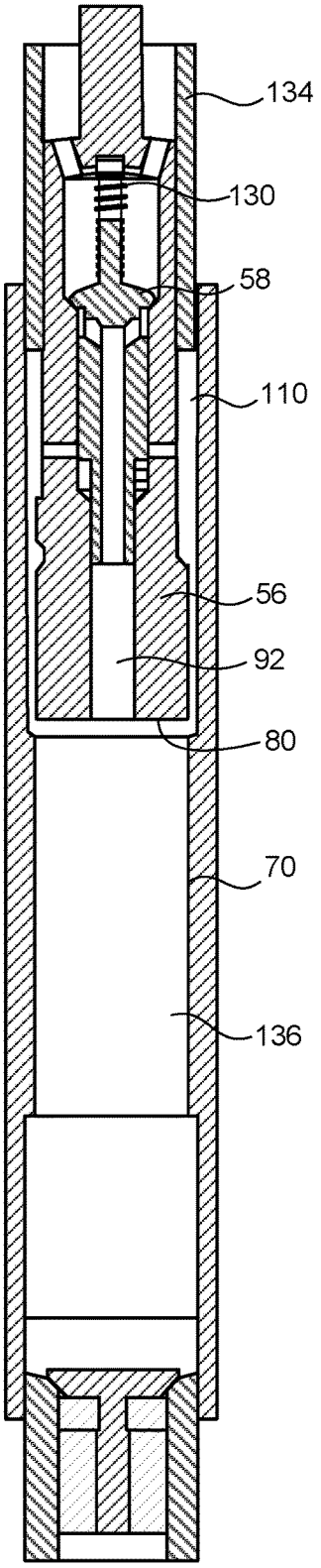
FIG. 9 is a cross-sectional view of the downhole pump system of the present invention in which the plunger is in a further upstroke position.

FIG. 9 shows a further upward position of the plunger 56 during the upstroke. As can be seen, the bottom 80 of the plunger 56 has separated from the narrow inner diameter section 70 of the barrel 52. As such, the compressed fluid can flow through the space between the plunger 56 and the inner wall of the barrel 70 so as to clean the inner surfaces of the barrel 52 and to discharge sand therefrom. The above plunger area 134 and the below plunger area 136, along with the compression chamber 110, are balanced by the pressure fluid column. The spring 130 associated with the traveling valve 58 causes the traveling valve 58 and move to the closing time of the traveling valve 58 is controlled by the plunger channel 92 covering at the bottom.

Figure 10:
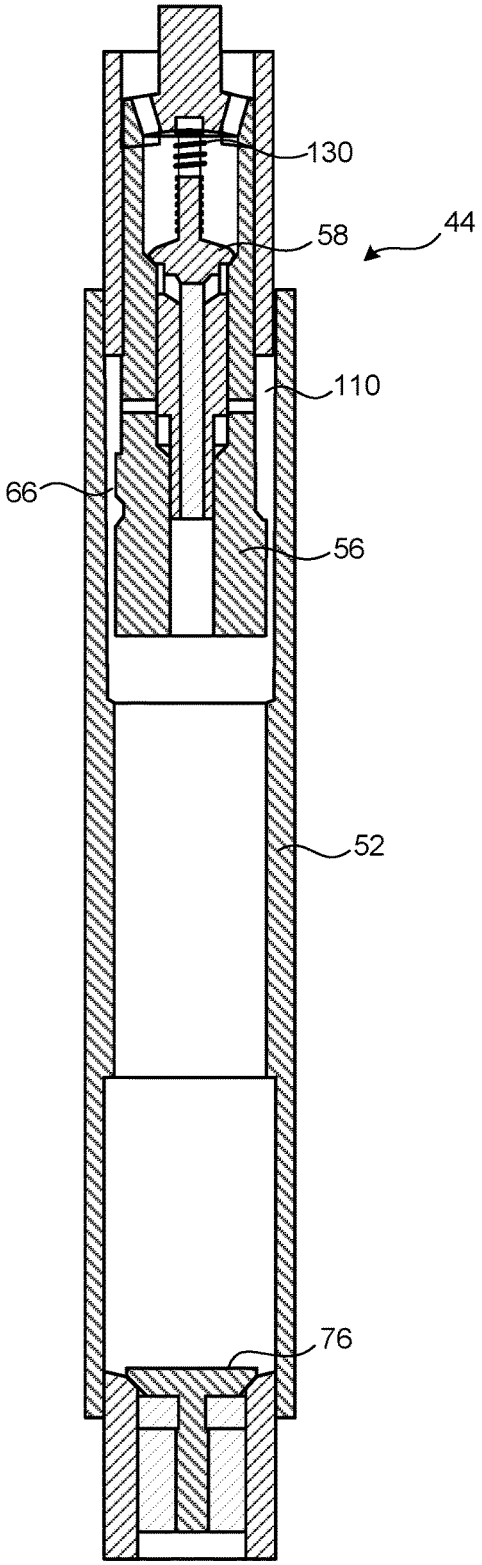
FIG. 10 is a cross-sectional view of the downhole pump system of the present invention in which the plunger is at the end of the upstroke and at the start of the downstroke.

FIG. 10 illustrates the plunger 56 in its uppermost positioned at the end of the upstroke and the start of the downstroke. This uppermost position can be controlled by a position indicator associated with the pump 44 of the present invention. The traveling valve 58 is illustrated as slightly open because the traveling valve's closing time is under control through the balancing between the spring force of the spring 130 and the drop pressure created by the pressure resulting until the start of the downstroke. The standing valve 76 is shown in a closed position. In particular, the compression chamber 110 is completely open since the outer wall of the plunger 56 is located within the first wide inner diameter section 66 of the barrel 52.

Figure 11:
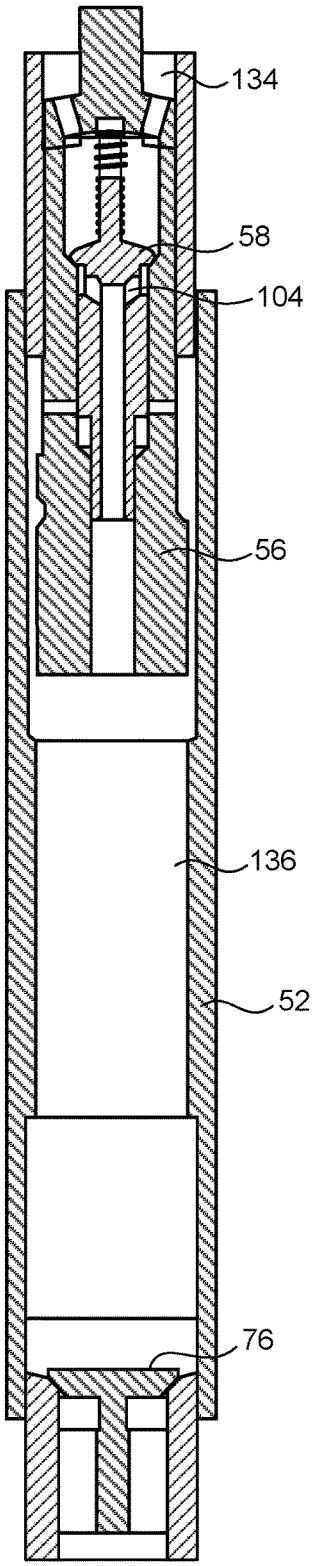
FIG. 11 is a cross-sectional view of the downhole pump system of the present invention showing the plunger in a further downstroke position.

FIG. 11 shows the start of the downstroke of the plunger 56. As can be seen in FIG. 11, the traveling valve 58 is in the open position. The standing valve 76 remains closed. The fluid can flow through the traveling valve 58, through the channel 104, and through the interior of the plunger 56.

Figure 12:
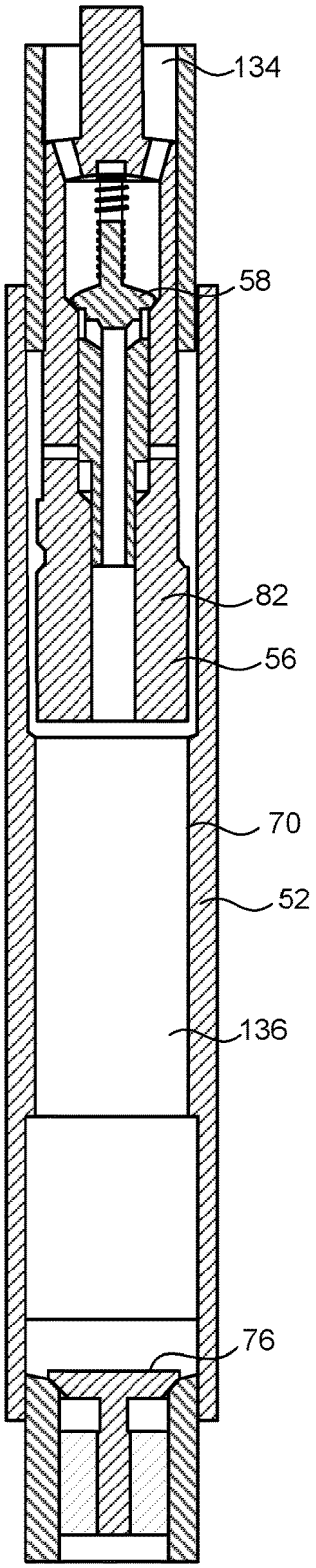
FIG. 12 is a cross-sectional view of the downhole pump system of the present invention showing the plunger in a further downstroke position.

FIG. 12 shows a further downstroke position of the plunger 56 within the barrel 52. As can be seen, the wide diameter section 82 of the plunger 56 is approaching the narrow inner diameter section 70 of the barrel 52. The standing valve 76 remains closed. The traveling valve 58 is open so as to equalize for fluid pressures in the above plunger area 134 and the below plunger area 136.

Figure 13:
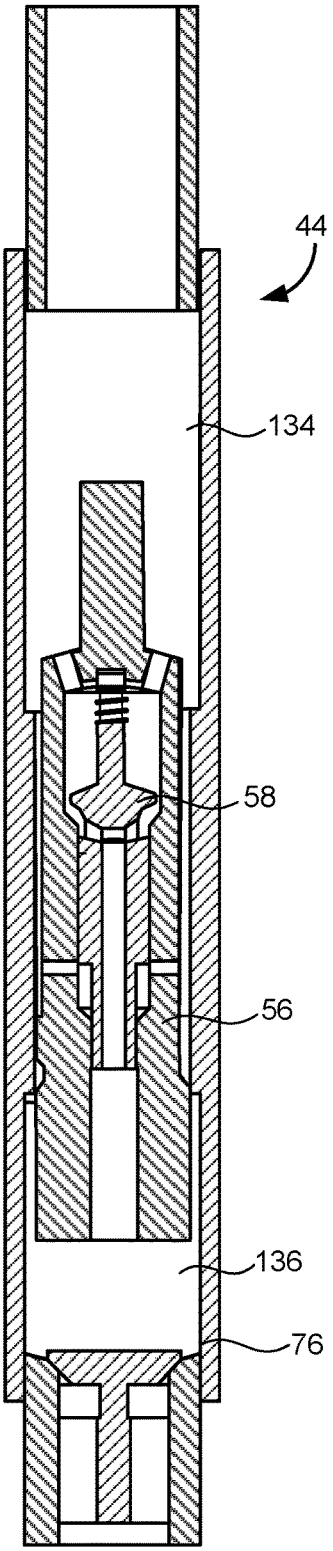
FIG. 13 is a cross-sectional view of the downhole pump system of the present invention showing the plunger near the end of the downstroke.

FIG. 13 shows the plunger 56 near the bottom of the downstroke. In this position, the traveling valve 58 remains open. The standing valve 76 remains closed. The fluid will flow through the traveling valve 58 in the manner described hereinafter from the below plunger area 136 toward the above plunger area 134. As a result, the pump 44 is able to accumulate fluid in the above plunger area 134. The plunger 56 remains covered but close to the opening area.

Figure 14:
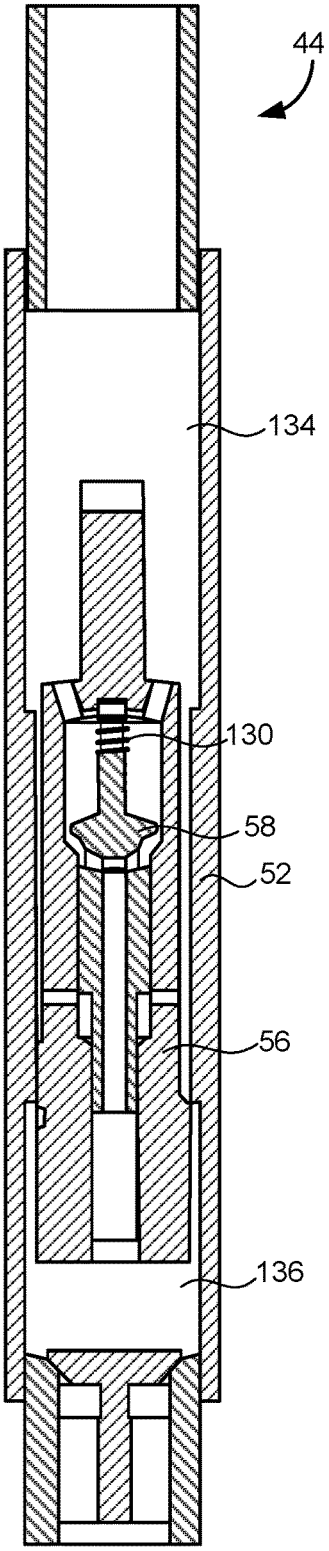
FIG. 14 is a cross-sectional view of the downhole pump system of the present invention showing the plunger at the end of the downstroke.

FIG. 14 shows the plunger 56 in the at the end of the downstroke. The plunger 56 is uncovered in this position. The below plunger area 136 and the above plunger area 134 are connected through the interior structures of the plunger 56. Fluid will flow from the below plunger area 136 to the above plunger area 134 through the plunger until the end of the downstroke. This helps to evacuate solids from the plunger 56 along with the barrel 52. The traveling valve 58 is slightly open because the closing time of the traveling valve is under the control of the spring force of spring 130 and the pressure drop created by the covering of the plunger hole.

Figure 15:
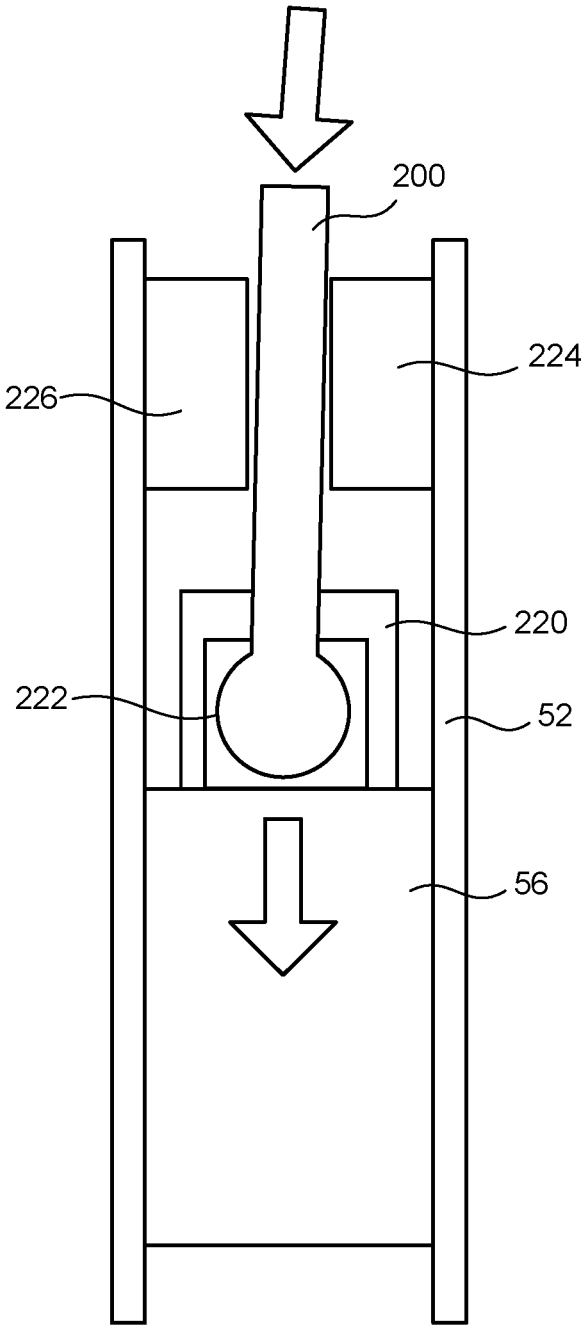
FIG. 15 is a diagrammatic illustration showing a technique whereby the pump system of the present invention can be utilized in association with deviated production tubing.

FIG. 15 is an illustration of a mechanism for controlling the movement of the plunger 56 within the barrel 52. In particular, the rod 200 is connected within a housing 220 located at the top of the plunger 56. In particular, the housing 220 serves to retain a pivot mechanism 222 therein. Stops 224 and 226 serve to restrict the amount of pivotal movement of the rod 200 relative to the piston 56. This configuration facilitates the ability to utilize the pump of the present invention in associated with deviated production tubing. As a result of the construction of FIG. 15, the rod 20 can create proper movement of the piston 56 within the barrel 52 regardless of the angle of orientation of the production tubing. The pivot mechanism is free floating so as to absorb any misalignment.

FIGS. 16A-16I show sequentially the operation of the fluid pump apparatus 300 in accordance with a first alternative embodiment of the present invention. This first alternative embodiment is an alternative to the previous embodiment so as to will have only two sealing areas during the upstroke between the above plunger area and the under plunger area instead of three sealing areas. There is also a top guidance cylinder of the traveling valve.

Figure 16A:
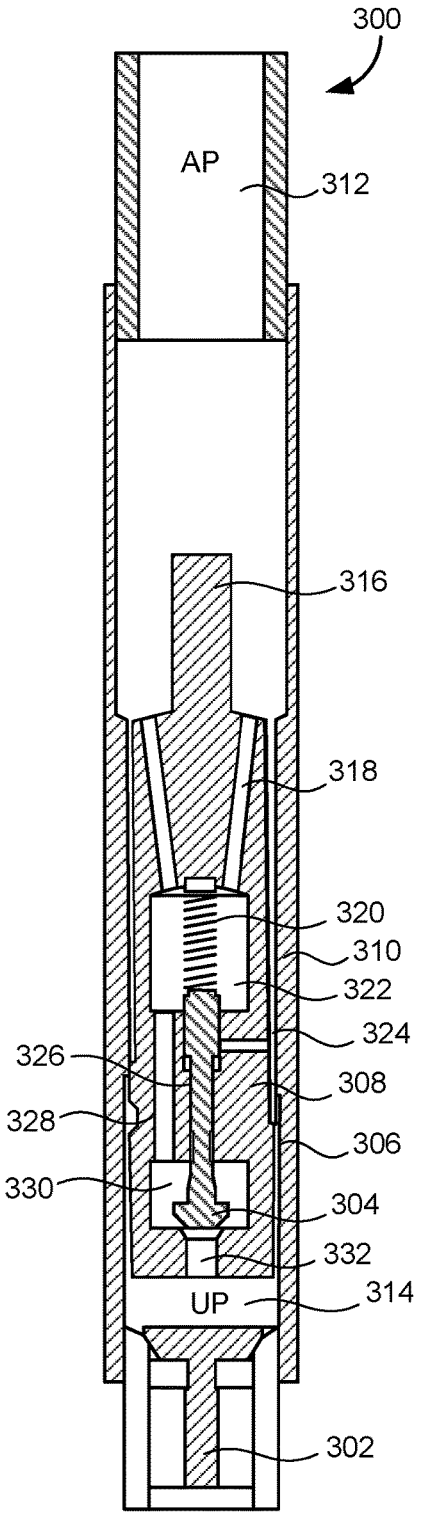
FIGS. 16A-16I show the various stages associated with the fluid pump apparatus in accordance with a first alternative embodiment of the present invention.

The fluid pump apparatus 300, shown in FIG. 16A, is illustrated at the start of the upstroke of the plunger. In this position, the standing valve 302 is closed. The traveling valve 304 is slightly open. The wide diameter section of the plunger 306 of the plunger 308 is uncovered by the inner wall of the barrel 310. The above plunger area 312 and the under plunger area 314 are connected through the uncovered area between the plunger 308 and the inner wall of the barrel 310. The plunger over-stroke compensates for the approximation of the barrel/rod string position.

As with the previous embodiment, it can be seen that there is a rod 316 that extends upwardly from the plunger 308. An aperture 318 extends so as to open to the interior of the barrel 310 in the above plunger area 312. A spring 320 is mounted in the central chamber 322 so as to bear against the interior of the plunger 308 and also to bear against the traveling valve 304. Another aperture 324 opens through the wall of the plunger 308 so as to communicate with the channel 326 that extends longitudinally within the plunger 308. Another channel 328 communicates between the central chamber 322 and the chamber 330. In FIG. 16A, it can be seen that the wide end of the traveling valve 304 is slightly opened with respect to the longitudinal channel 332 that extends from the bottom of the plunger 308 toward the chamber 330.

Figure 16B:
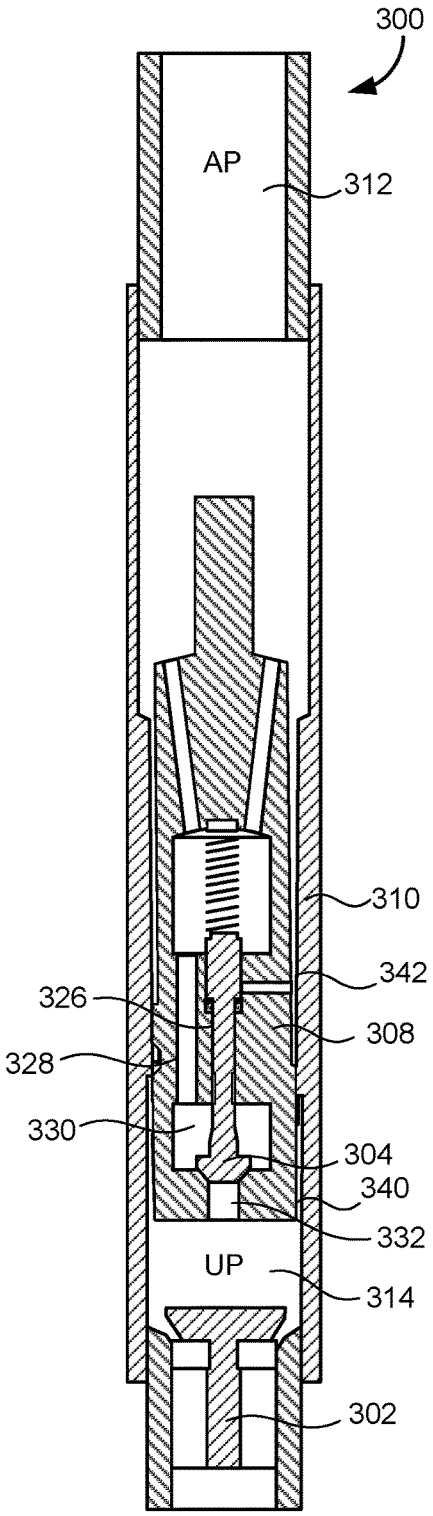

FIG. 16B shows that the initialization of a first stage of the upstroke of the plunger 308 within the interior of the barrel 310. In this position, the standing valve 302 is opened. It will remain open until the end of the initial stage of the first upstroke position. The standing valve is open as wide as possible so as to facilitate solids evacuation. The wide diameter section 340 of the plunger 308 is shown as covered by the reduced diameter section 342 and the inner wall of the barrel 310. The above plunger area 312 and the under plunger area 314 are isolated from each other and closed with respect to each other. The traveling valve 304 is illustrated as sealed closed and seated over the channel 332. The traveling valve 304 will be closed because the above plunger pressure is greater than the under plunger pressure. The under plunger area 314 can then begin filling with fluids.

Figure 16C:
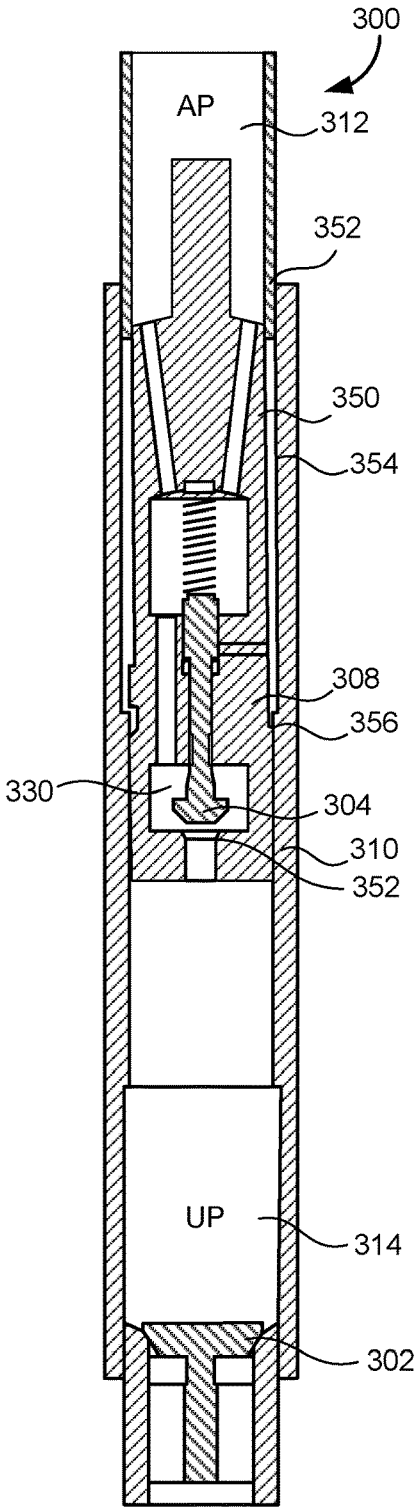

FIG. 16C shows the end of the first stage of the upstroke. In FIG. 16C, it can be seen that the narrow diameter section 350 of the plunger 308 will be engaged with the inner wall of the upper pipe 352. The inner wall of the pipe 352 has a diameter less than the narrowest inner diameter of the barrel 310. The fluid within the compression chamber 354 is suitably compressed in the area between the outer shoulder 356 of the plunger 308 and the end of the upper pipe 352. The traveling valve 304 will unseat from its position over the channel 352. The above plunger area 312 and the under plunger area 314 will be connected through the opening caused by the movement of the traveling valve 304. In other words, fluid will flow from chamber 330 through the channel 352 and into the under plunger area 314. The pressure fluid column in the above plunger area 312 is transmitted to the under plunger area 314. The standing valve 302 is suitably closed.

Figure 16D:
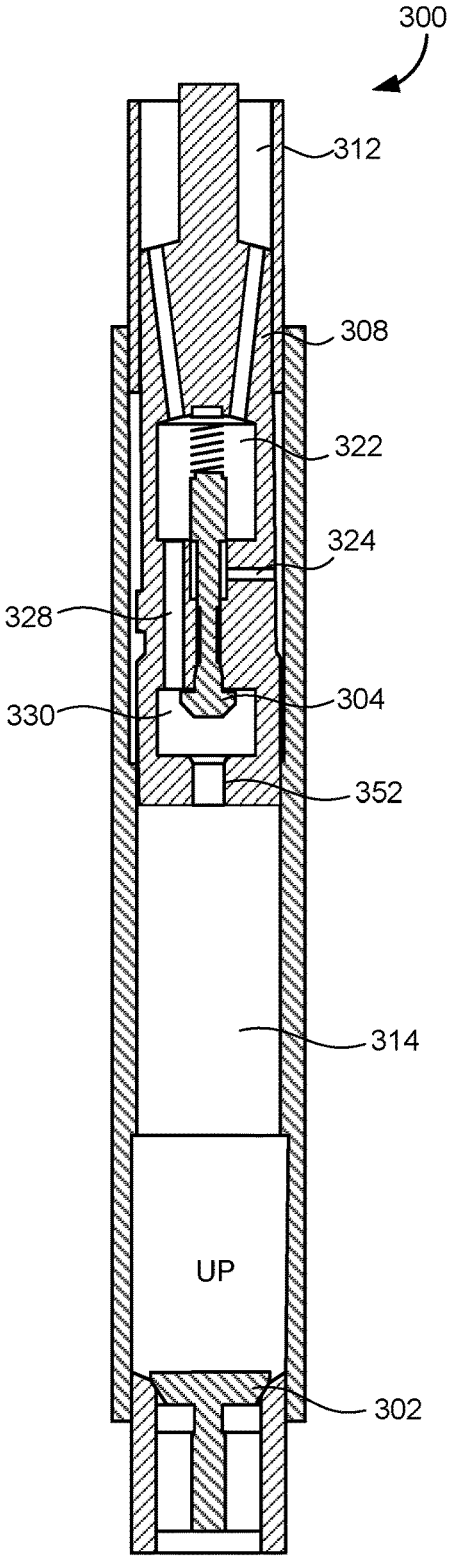

FIG. 16D shows the end of an upper stage of the upstroke of the plunger 308. It can be seen that the traveling valve 304 is moved upwardly away from the channel 352. The traveling valve 314 moves so as to uncover the aperture 324 and to unblock the opening to the chamber 322. The flow through these areas will help to evacuate solids from the respective chambers 322 and 330. In particular, the fluid flow through from the chamber 322 through the aperture 328 facilitates this solids evacuation. The above plunger area 312 is still fluidically connected to the under plunger area 314. The above plunger area 312 and the under plunger area 314 are balanced with the pressure fluid column. This means that the under plunger area 314 is filled regardless of the initial gas quantity in the above plunger area 312. The standing valve 302 remains closed.

Figure 16E:
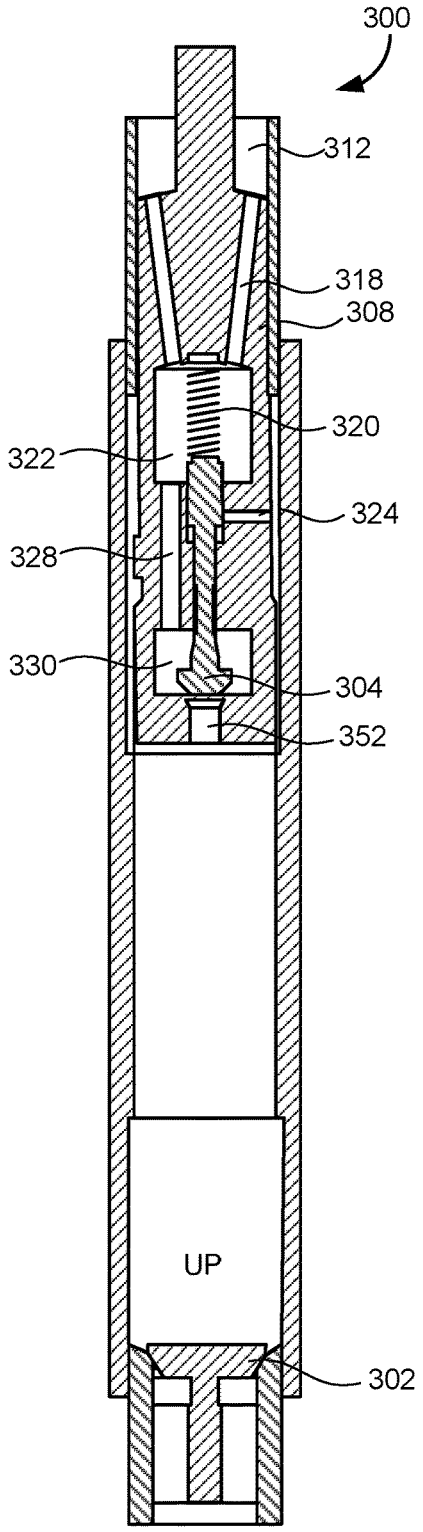

FIG. 16E shows the end of a third stage of the upstroke of the plunger 308. The chambers 322 and 330 remain connected through the aperture 328. Additionally, the chambers 322 and 330 communicate fluidically through the apertures 318 to the above plunger area 312. The above plunger area 312 and the under plunger area 314 along with the chambers are balanced with the pressure fluid column. The spring 320 urges to close the traveling valve 304 and to close the aperture 324. The closing time for the traveling valve 304 is going to close the channel 352. The standing valve 302 remains closed.

Figure 16F:
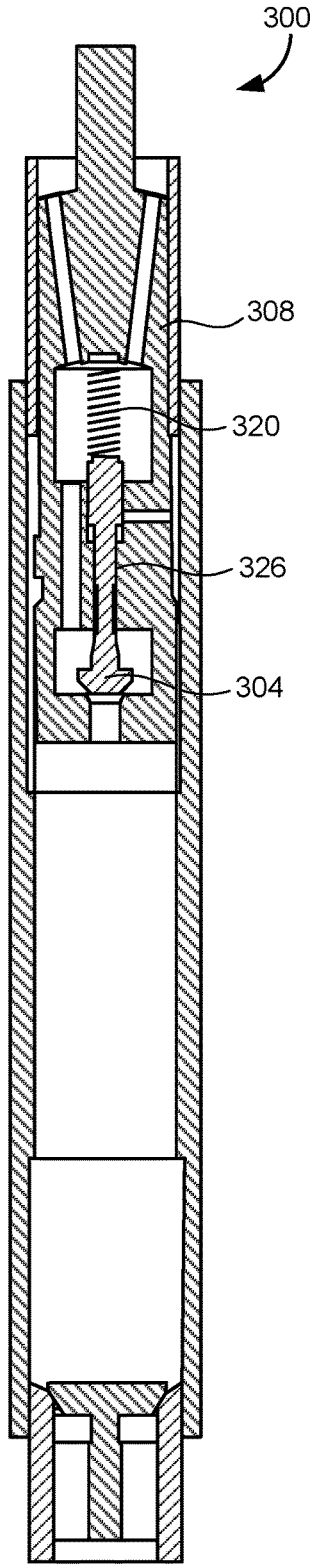

FIG. 16F shows the end of the upstroke of the plunger 308 and the start of the downstroke of the plunger 308. The overstroke will compensate for the approximation of the barrel/rod string position. It can be seen that the traveling valve 304 is slightly opened because the closing time for the traveling valve 304 is under control through the balancing between the spring force of spring 320 and the drop of pressure created into the plunger channel until the downstroke begins.

Figure 16G:
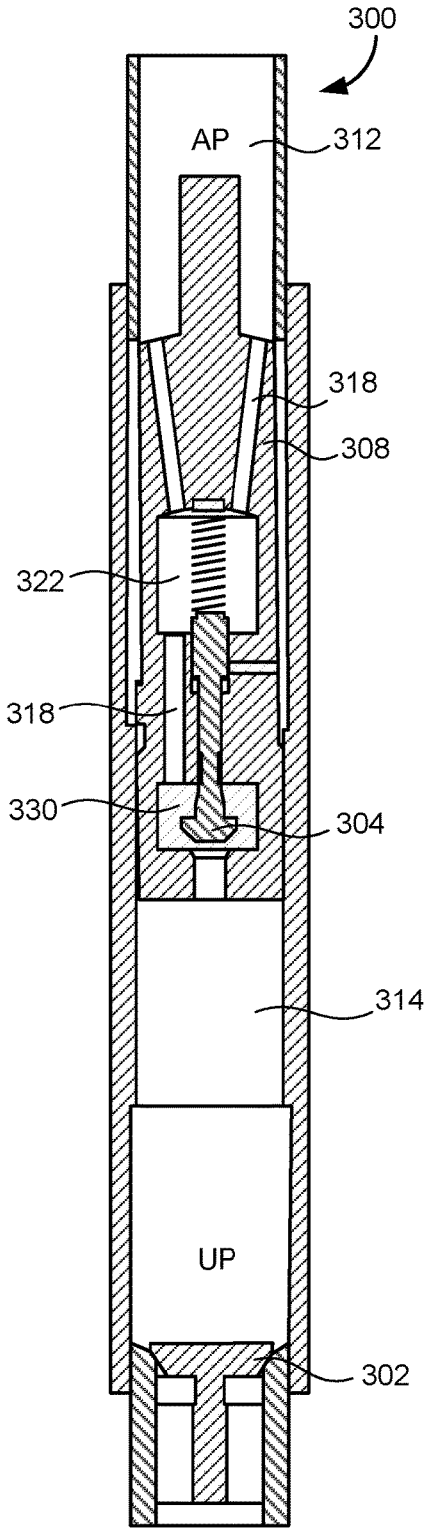

FIG. 16G illustrates a first stage of the downstroke of the plunger 308. In this first stage of the downstroke, the traveling valve 304 remains opened because fluid flow therethrough. The standing valve 302 remains closed. The fluid will flow through the traveling valve 304 by the flow of fluids from the under plunger area 314 upwardly through the chamber 330, through aperture 328 into chamber 322 and outwardly through the apertures 318 to the above plunger area 312.

Figure 16H:
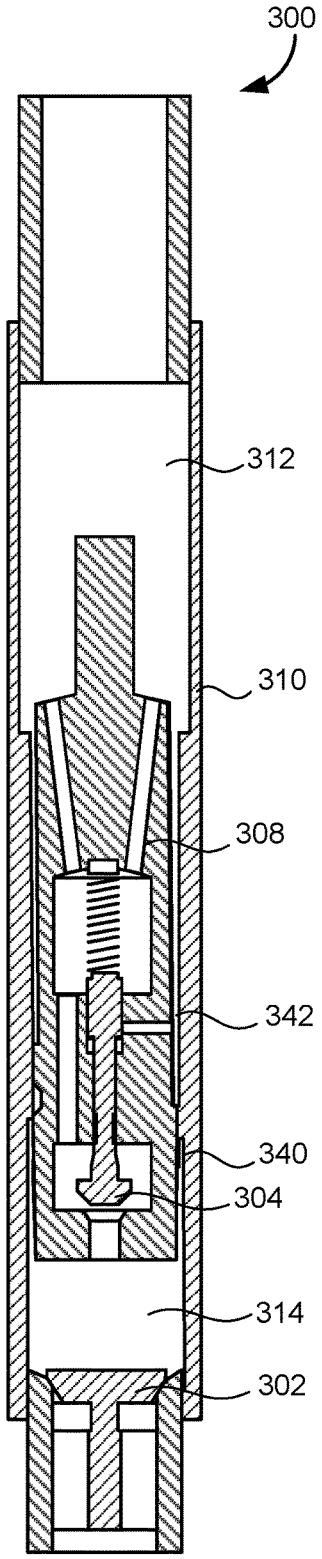

FIG. 16H shows the end of the downstroke of the piston 308. At the end of the downstroke, the traveling valve 304 is still opened due to the flowing of fluids. The standing valve 302 remains closed. The wide diameter section 340 of the plunger 308 is sealed against the reduced diameter section 342 of the barrel 310.

Figure 16I:
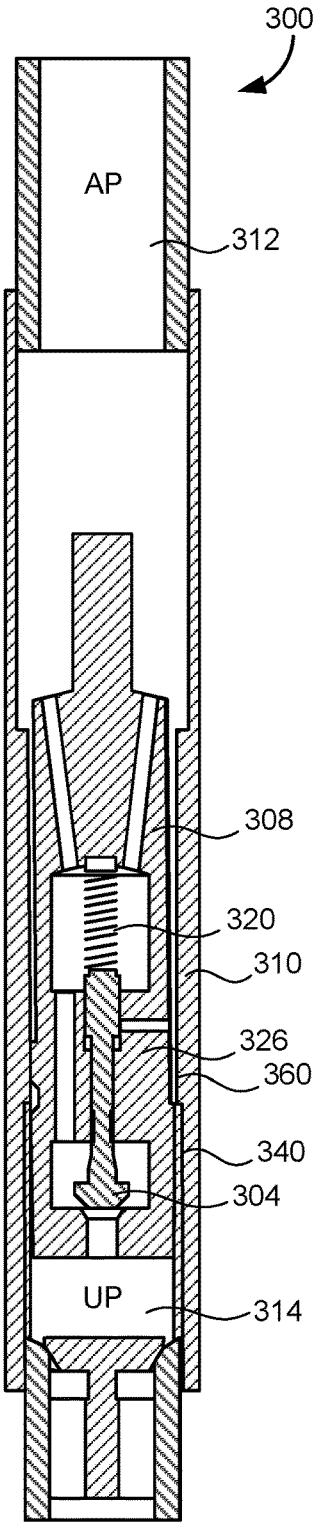

FIG. 16I shows the conclusion of the downstroke of the plunger 308. In this final position, the wide diameter section 340 of the of the plunger 308 is uncovered from the inner walls of the barrel 310. The above plunger area 312 is connected to the under plunger area 314 through the opening 316 created between the outer walls of the plunger 308 and the inner wall of the barrel 310. Fluid will flow from the upper plunger area 312 from the under plunger area 314 to the above plunger area 312 through this opening 360 until the end of the downstroke. This helps to evacuate solids from the plunger 308 and the barrel 310. The traveling valve 304 will remain slightly opened because the traveling valve's closing time is under control through the balancing between the spring 320 and the drop force created by the covering of the channel in the plunger of the channel 326 of the plunger 308.

FIGS. 17A-17I show the various stages during the operation of a second alternative embodiment of the fluid pump apparatus 400 of the present invention. This second alternative embodiment allows only two sealing areas during the upstroke between the above plunger area 402 and the under plunger area 404. A different configuration of the traveling valve 406 is particularly shown.

Figure 17A:
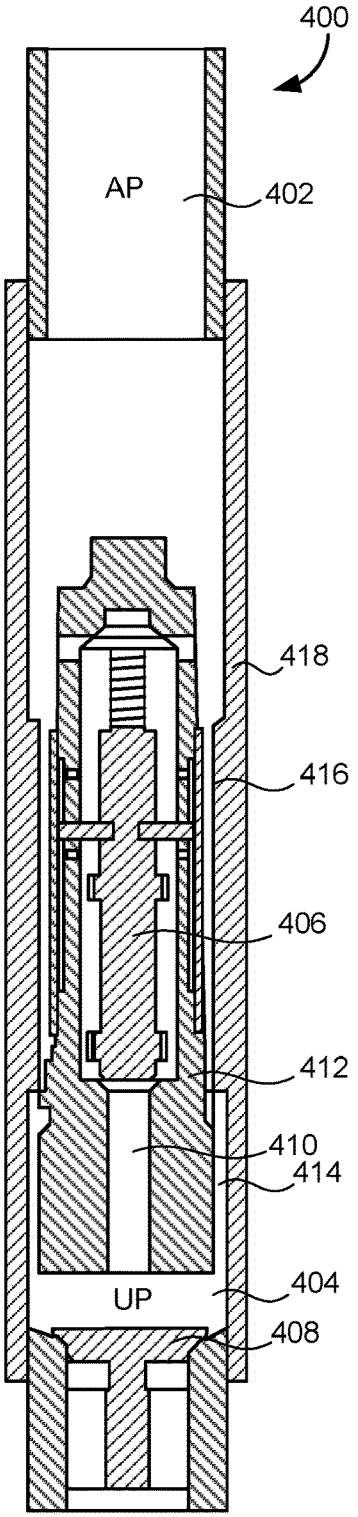
FIGS. 17A-17I show the sequential stages associated with a second alternative embodiment of the fluid pump apparatus of the present invention.

FIG. 17A shows the start of the upstroke of the fluid pump apparatus 400 of the present invention. As can be seen in FIG. 17A, the standing valve 408 is closed. The traveling valve 406 is slightly open with respect to the channel 410 in the plunger 412. The wide diameter section 414 of the plunger 402 is uncovered. The above plunger area 402 is connected to the under plunger area 404 through a flow path 416 formed between the outer wall of the plunger 402 and the inner wall of the barrel 418. The overstroke position of the plunger 412 compensates for the approximation of the barrel/rod string position.

Figure 17B:
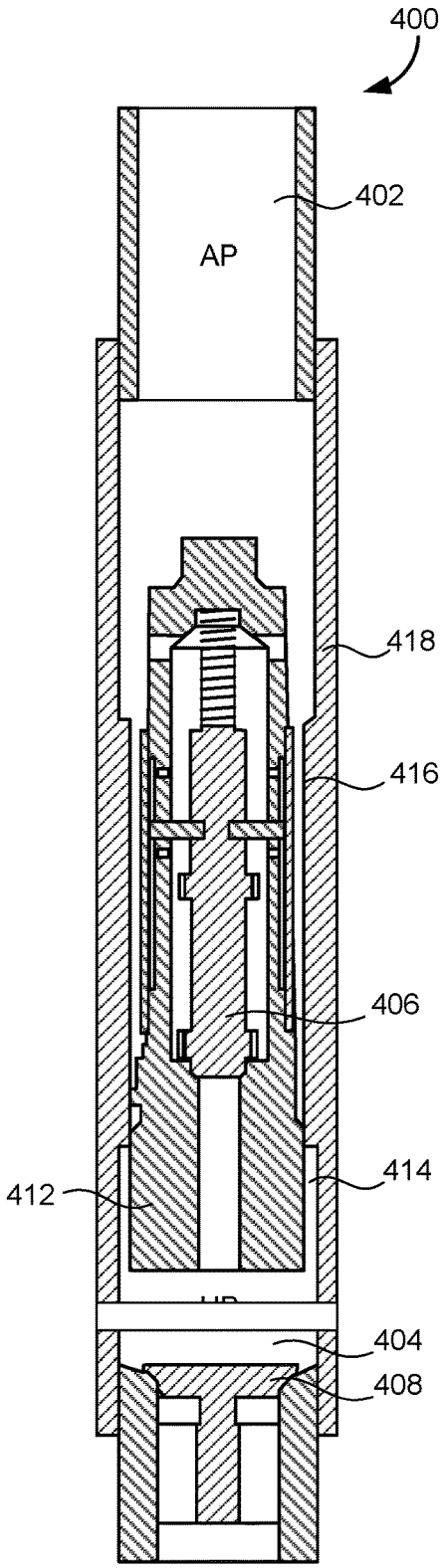

FIG. 17B illustrates an initial stage of the upstroke of the fluid pump apparatus 400 of the present invention. In this initial stage, the standing valve 408 is opened until the end of this initial stage of the upstroke. The standing valve 408 will be open as wide as possible so as to facilitate solids evacuation. The flow path 416 will be closed because of the sealing relationship between the wide diameter section 414 of the plunger 412 and the reduced diameter section 416 of the barrel 418. In this position, the above plunger area 402 is isolated from the under plunger area 404. The traveling valve 406 will be closed because the above plunger pressure will be greater than the under plunger pressure. In this initial stage of the upstroke, the under plunger area 404 will begin filling with fluid.

Figure 17C:
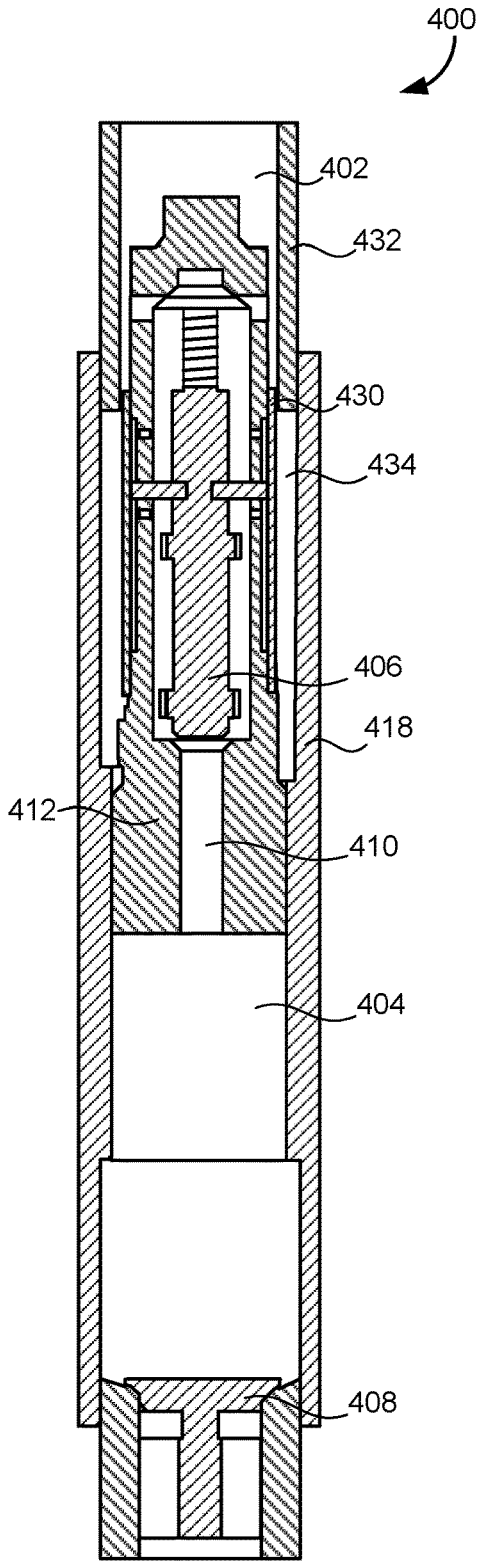

FIG. 17C shows the end of the first stage of the upstroke. In this configuration, the narrow diameter section 430 of the plunger 412 is engaged with the inner wall of the upper pipe 432. As stated hereinbefore, the inner diameter of the upper pipe 432 is less than the smallest diameter of the inner wall of the barrel 418. The compression chamber 434 is compressed so that the volume will push the sleeve 430 toward the top. The traveling valve 406 will unseat from covering the channel 410. The above plunger area 402 will be connected to the under plunger area 404 through the opening created by the traveling valve 406. As such, the pressure fluid column in the above plunger area 402 is transmitted to the under plunger area 404. The standing valve 408 remains closed.

Figure 17D:
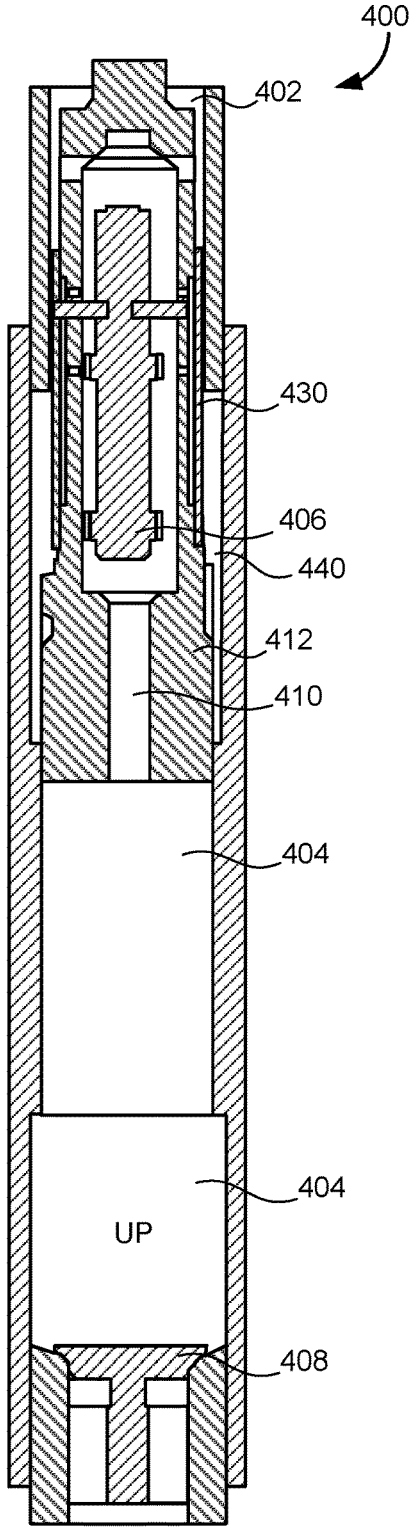

FIG. 17D illustrates the end of a second stage of the upstroke of the plunger 412. In this configuration, the traveling valve 406 moves upwardly and away from the channel 410 so as to cause an opening 440 between the interior of the sleeve 430 and the outer surface of the plunger 412. This flow will evacuate solids from the area between the inner wall of the sleeve 430 and the outer wall of the plunger 412. The above plunger area 402 is still connected to the under plunger area 404. The pressure and the above plunger area 402 and the under plunger area 404 are balanced with the pressure fluid column. This means that the under plunger area is filled regardless of the initial gas quantity in the under plunger area 404. The standing valve 408 remains closed.

Figure 17E:
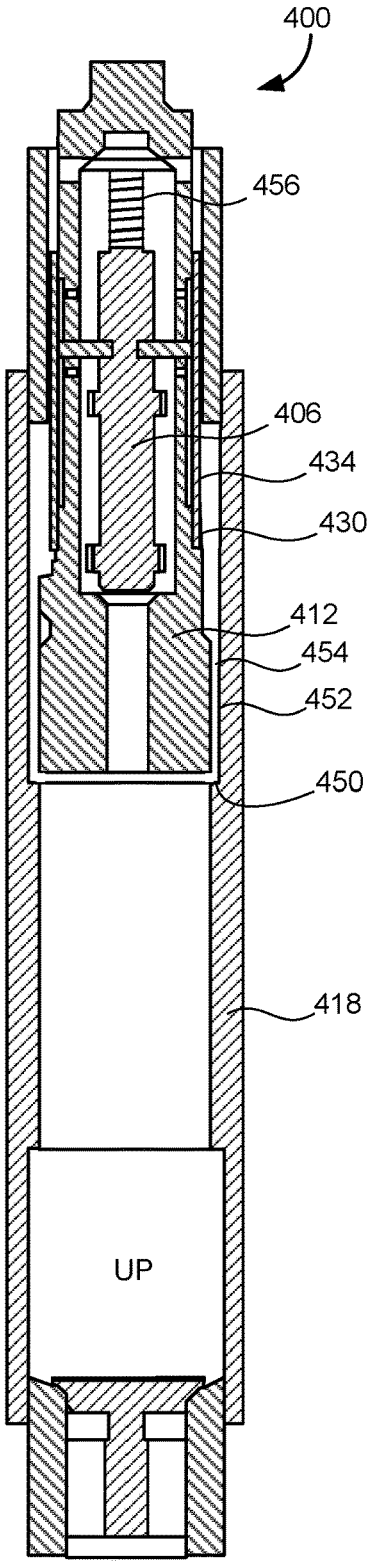

FIG. 17E shows the end of a third stage of the upstroke of the plunger 412 in the fluid pumping apparatus 400. In this configuration, the compression chamber 434 is connected to the above plunger area 402 through the space 450 formed between the first wide inner diameter section 452 of the barrel 418 and the wide outer diameter section 454 of the plunger 412. This space 450 serves to create an opening which helps to evacuate solids from the plunger 412 and the compression chamber 434. The above plunger area 402 and the under plunger area 404, along with the compression chamber 434, are balanced with the pressure fluid column. The traveling valve 406 being closed by the action of the spring 456. The closing time for the traveling valve 406 is controlled by the compression chamber 434 and until the covering of the sleeve 430 at the bottom thereof.

Figure 17F:
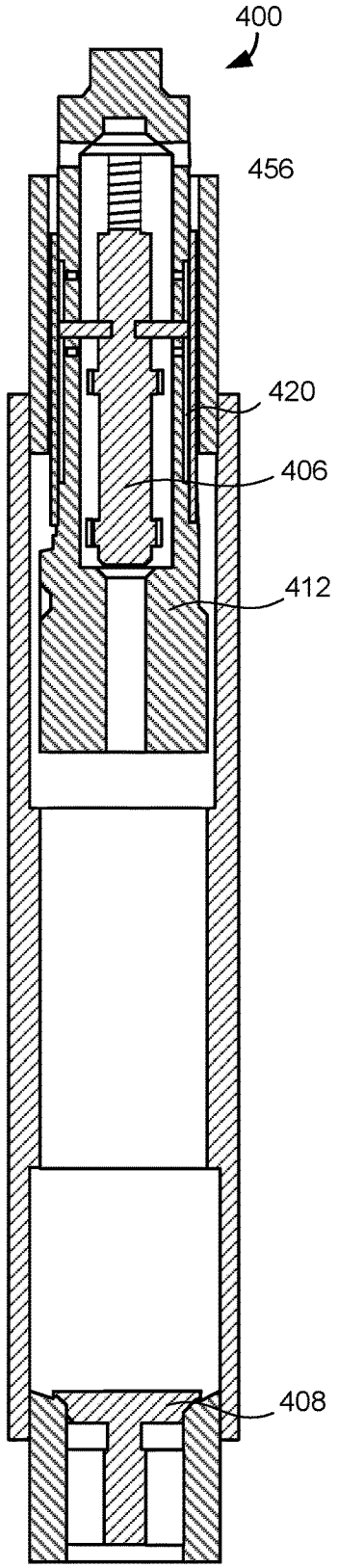

FIG. 17F shows the end of the upstroke in the start of the downstroke of the barrel 412 of the fluid pumping apparatus 400 of the present invention. The overstroke compensates for the approximation of the barrel/rod string position. The traveling valve 406 is lightly open because the closing time of the traveling valve is under control through the balancing between the spring force and the drop pressure created by the sleeve 430 in relation to the plunger 412. The standing valve 408 remains closed.

Figure 17G:
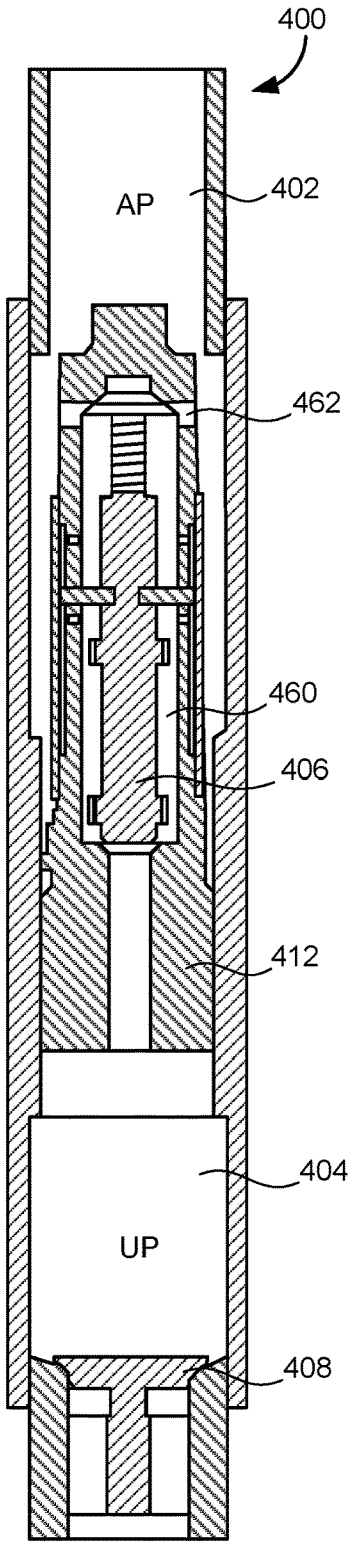

FIG. 17G shows an initial stage of the downstroke of the piston 412 in the fluid pumping apparatus 400 of the present invention. In this configuration, it can be seen that the traveling valve 406 is opened due to the flowing of fluids therethrough. The standing valve 408 remains closed. Fluid will flow through the traveling valve 406 from the under plunger area 404 for transfer through the central chamber 460 of the plunger 412 and through the apertures 462 into the above plunger area 402.

Figure 17H:
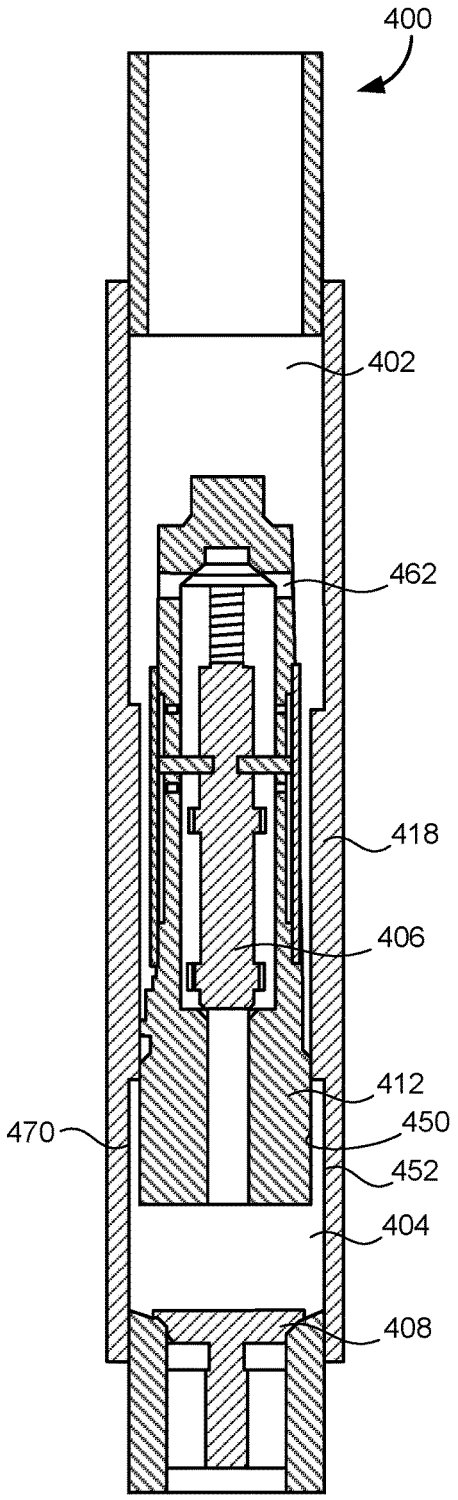

FIG. 17H shows the end of the first stage of the downstroke of the plunger 412 within the fluid pumping apparatus 400 of the present invention. It can be seen that the traveling valve 406 is still opened due to the flowing of fluids therethrough. The standing valve 408 remains closed. Fluid flows through the traveling valve 406 by fluid transfer between the under plunger area 404 and the above plunger area 402. The flow path 470 between the wide diameter section 452 of the plunger 412 and the second wide inner diameter section 450 of the barrel 418 is illustrated as closed.

Figure 17I:
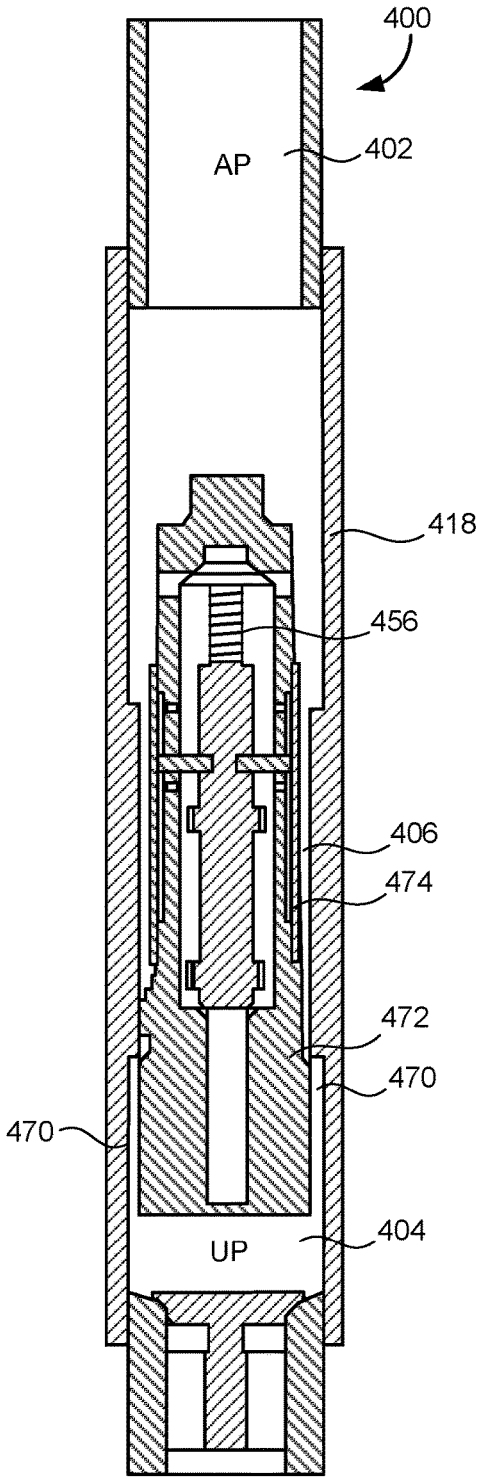

FIG. 17I illustrates the end of the second stage of the downstroke of the fluid pumping apparatus 400 the present invention. The end of the second stage of the downstroke has the flow path 470 uncovered. The above plunger area 402 is connected to the under plunger area 404 through the flow path X. Fluid will flow from the under plunger area 404 to the above plunger area 402 through this flow path X until the end of the downstroke. This helps to evacuate solids from the plunger 412 and from the interior of the barrel 418. The traveling valve 406 is lightly open to cause the traveling valve's closing time to be under control through the balancing between the spring force of the spring 456 and the drop pressure created by the flow path 474.

Figure 18A:
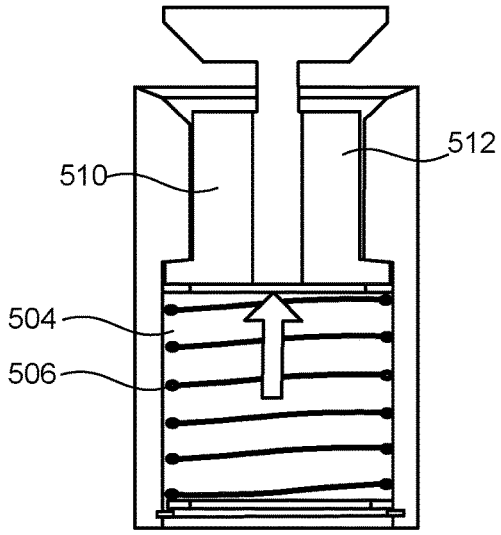
FIGS. 18 and 18A illustrate an alternative embodiment of the present invention wherein the standing valve is spring-loaded so as to maximize solids evacuation.
Figure 18B:
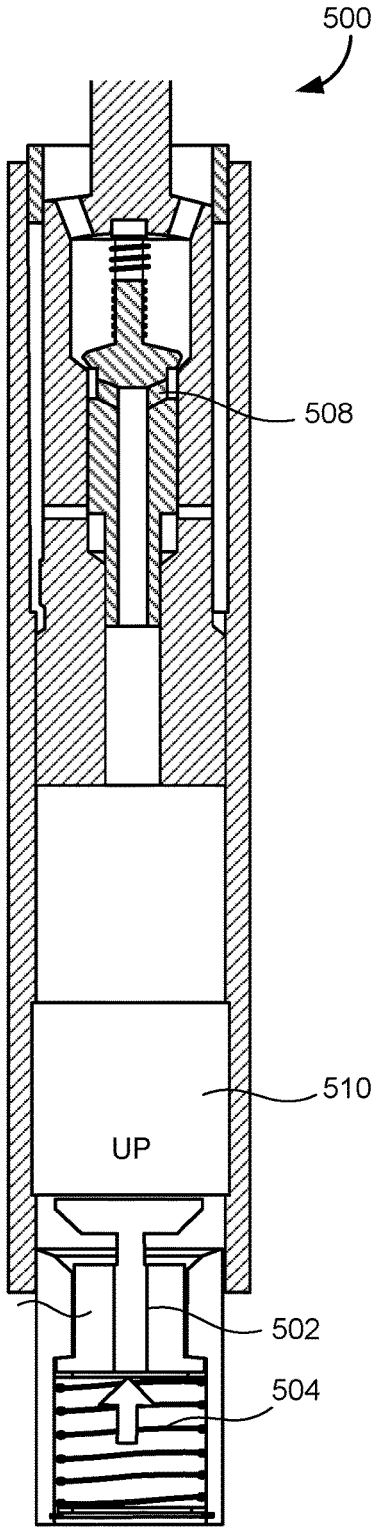

FIGS. 18 and 18A illustrate an alternative embodiment of the present invention wherein the standing valve is spring-loaded so as to maximize solids evacuation. FIG. 18A shows the standing valve 502 abutting a return spring 504. The spring force is shown at 506. In the alternative embodiment of the present invention, the standing valve 502 is opened by the reverse return spring 504. This is opposite to the conventional use of return springs wherein the return springs are used for closing a valve. The flat top of the standing valve 502 could have a conical shape or other profile in order to facilitate the evacuation of solids accumulated on it.

In the alternative embodiment of the present invention, the closure of the standing valve 502 is delayed during the end of the upstroke phase of the fluid pump apparatus 500, as is shown in FIG. 18. At this time, the flow is delivered from the fluid column (under high pressure) through port 508, acting as a flushing of the area 510.

The delay of closing of the standing valve 502 will depend on the balance between the spring force 506, the passage area thru standing valve 502, and the passage area through traveling valve (via port 508). The minimum pressure required in "UP" chamber 510 to close the valve 502 corresponds to the force 504 applied on section 512 of standing valve 502. So, once the flow through the traveling valve is great enough big to create the minimum pressure, the standing valve will close and will be fully closed before the end of the upstroke phase. Note that the return spring characteristics will have to be defined according depth level range of the well.

The spring-loaded standing valve 502 shown in FIGS. 18 and 18A can be used as an alternative to the standing valves shown and described in each of the embodiments above.

The present invention provides a downhole pump that has a fixed barrel with a reciprocating plunger moving therein by way of a rod string. A standing valve is located at the bottom of the barrel and a traveling valve is at the plunger. The barrel chamber is provided between the traveling valve and the standing valve and expands during an upstroke movement and contracts during the downstroke movement. A hydraulic actuation system is provided to open the traveling valve before the end of the upstroke in order to make communication between the barrel chamber and the fluid column. When the traveling valve is open, the weight of the column ensures the pressure balancing instantaneously regardless of the gas volume within the barrel chamber. This occurs through the use of the opening traveling valve. Gas within the barrel chamber can vent through the traveling valve in order to prevent gas locks. The immediate balancing pressure above and below the plunger allows the ability to minimize stress on the sucker rods in order to avoid the fluid pounding effect. As such, damage to the rod string is effectively prevented. As a result, the present invention reduces the need to ever pull the rod string. This avoids the very expensive, labor-intensive, and equipment-intensive procedures. It also serves to avoid lost production. The present invention effectively provides a mechanism whereby any solids present within the pump can be discharged so as to avoid a sand locking of the piston or damage to the components of the plunger and barrel.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. A fluid pump apparatus for an artificial lift system, the fluid pump apparatus comprising:

a barrel having an interior and a lower end, said barrel having a first wide inner diameter section and a second wide inner diameter section and a reduced inner diameter section between said first wide inner diameter section and said second wide inner diameter section, said barrel having an opening at a top thereof and an opening at the lower end thereof;

a standing valve positioned at said lower end of said barrel, said standing valve movable between an open position and a closed position;

a plunger reciprocatingly mounted within said barrel, said plunger having a wide diameter section and a narrow diameter section positioned above said wide diameter section, said plunger having a first aperture at an upper portion of said plunger and a second aperture extending through a wall of said plunger so as to open to a channel extending longitudinally through said plunger, said plunger having a central chamber, said central chamber having a first shoulder located below said first aperture and above said second aperture;

a traveling valve positioned in an interior of said plunger so as to control fluid flow through said plunger, said traveling valve having a head portion and a body extending downwardly from said head portion, said body slidably movable within an interior of said plunger, said body having a fluid-passing channel therein that opens to an exterior of said body, said shoulder defining a seating area for said traveling valve; and a spring mounted to said plunger and to said traveling valve so as to urge said traveling valve into sealing relation with said shoulder of said plunger.

2. The fluid pump apparatus of claim 1, said standing valve having a flat surface of the top thereof, said flat surface positioned within said interior of said barrel.

3. The fluid pump apparatus of claim 2, said standing valve having a stem extending outwardly from said flat surface, said stem extending through said opening at said lower end of said barrel.

4. The fluid pump apparatus of claim 1, said plunger having a rod extending upwardly from a top thereof, said rod adapted to be connected to a sucker rod of the artificial lift system.

5. The fluid pump apparatus of claim 1, said head portion of said traveling valve having a diameter suitable for seating on said shoulder of said plunger.

6. The fluid pump apparatus of claim 1, said body having a tubular member extending outwardly therefrom, said tubular member having an outer diameter less than an inner diameter of said channel of said plunger, said tubular member being slidable within said channel.

7. The fluid pump apparatus of claim 6, said tubular member having a bottom that is spaced from said channel of said barrel.

8. The fluid pump apparatus of claim 1, further comprising:

an upper pipe connected to an upper end of said barrel, said upper pipe adapted to be secured to production tubing of the artificial lift system.

9. The fluid pump apparatus of claim 8, said traveling valve being movable to a position such that said reduced inner diameter section bears against said wide diameter section of said plunger so as to define a compression chamber in an area between said narrow section of said plunger and said first wide inner diameter section of said barrel, an upper end of said narrow diameter section of said plunger being in sealing relation with an inner diameter of said upper pipe.

10. The fluid pump apparatus of claim 1, said traveling valve being movable to a position such that said reduced inner diameter section bears against said wide diameter section of said plunger so as to define a compression chamber in an area between said narrow diameter section of said plunger and said first wide inner diameter section of said barrel.

11. The fluid pump apparatus of claim 10, said traveling valve being movable to a position such that said wide diameter section of said plunger is spaced from said reduced inner diameter section of said barrel so as to release compressed gas from said compression chamber toward said interior of said barrel and toward a bottom of said plunger.

12. A fluid pump apparatus for an artificial lift system, the fluid pump apparatus comprising:

a barrel having an interior and a lower end, said barrel having a first wide inner diameter section and a second wide inner diameter section and a reduced inner diameter section between said first wide inner diameter section and said second wide inner diameter section, said barrel having an opening at a top thereof and an opening at the lower end thereof;

a standing valve positioned at said lower end of said barrel, said standing valve movable between an open position and a closed position;

a plunger reciprocatingly mounted within said barrel, said plunger having a wide diameter section and a narrow diameter section positioned above said wide diameter section, said plunger having a first aperture at an upper portion of said plunger and a second aperture extending through a wall of said plunger so as to open to a channel extending longitudinally through said plunger;

a traveling valve positioned in an interior of said plunger so as to control fluid flow through said plunger, said traveling valve having a head portion and a body extending downwardly from said head portion, said body slidably movable within an interior of said plunger, said body having a fluid-passing channel therein that opens to an exterior of said body, said traveling valve being movable to a position in which fluid above said plunger passes through said first aperture into said channel of said plunger and passes through said fluid-passing channel of said body so as to pass into said interior of said barrel below a bottom of said plunger.

13. A fluid pump apparatus for an artificial lift system, the fluid pump apparatus comprising:

a barrel having an interior and a lower end, said barrel having a first wide inner diameter section and a second wide inner diameter section and a reduced inner diameter section between said first wide inner diameter section and said second wide inner diameter section, said barrel having an opening at a top thereof and an opening at the lower end thereof;

a standing valve positioned at said lower end of said barrel, said standing valve movable between an open position and a closed position;

a plunger reciprocatingly mounted within said barrel, said plunger having a wide diameter section and a narrow diameter section positioned above said wide diameter section, said plunger having a first aperture at an upper portion of said plunger and a second aperture extending through a wall of said plunger so as to open to a channel extending longitudinally through said plunger;

a traveling valve positioned in an interior of said plunger so as to control fluid flow through said plunger, said traveling valve having a head portion and a body extending downwardly from said head portion, said body slidably movable within an interior of said plunger, said body having a fluid-passing channel therein that opens to an exterior of said body, said plunger being movable to a lower position so as to cause said traveling valve to be in a seated position such that a fluid above said plunger flows through a space between said narrow diameter section of said plunger and said second wide inner diameter section of said barrel.

* * * * *